US008393729B2

(12) United States Patent
Silverbrook et al.

(10) Patent No.: US 8,393,729 B2
(45) **Date of Patent: *Mar. 12, 2013**

(54) CONTINUOUS WEB PRINTER WITH AIR PLATEN

(75) Inventors: Kia Silverbrook, Balmain (AU); Mark Profaca, Balmain (AU); Craig Donald Strudwicke, Balmain (AU); Jason Mark Thelander, Balmain (AU)

(73) Assignee: Zamtec Ltd, Dublin (IE)

( * ) Notice: Subject to any disclaimer, the term of this patent is extended or adjusted under 35 U.S.C. 154(b) by 170 days.

This patent is subject to a terminal disclaimer.

(21) Appl. No.: 12/859,777

(22) Filed: Aug. 20, 2010

(65) Prior Publication Data

US 2011/0043583 A1 Feb. 24, 2011

Related U.S. Application Data

(60) Provisional application No. 61/235,686, filed on Aug. 21, 2009.

(51) Int. Cl.
*B41J 2/01* (2006.01)
*B65H 29/24* (2006.01)

(52) U.S. Cl. ..... 347/104; 271/194

(58) Field of Classification Search ..... None
See application file for complete search history.

(56) References Cited

U.S. PATENT DOCUMENTS

| | | | | |
|---|---|---|---|---|
| 2,862,705 | A * | 12/1958 | Faeber | 226/92 |
| 4,200,342 | A * | 4/1980 | Fall | 384/19 |
| 5,913,268 | A * | 6/1999 | Jackson et al. | 101/420 |
| 6,533,169 | B2 * | 3/2003 | Robinson et al. | 235/375 |
| 6,672,706 | B2 * | 1/2004 | Silverbrook | 347/42 |
| 7,024,995 | B2 * | 4/2006 | Silverbrook | 101/424.1 |
| 8,033,624 | B2 * | 10/2011 | Silva et al. | 347/4 |
| 2002/0105571 | A1 * | 8/2002 | Izawa et al. | 347/104 |
| 2007/0217854 | A1 | 9/2007 | Silverbrook | |
| 2011/0043554 | A1 * | 2/2011 | Silverbrook et al. | 347/5 |
| 2011/0043580 | A1 * | 2/2011 | Silverbrook et al. | 347/104 |
| 2011/0043581 | A1 * | 2/2011 | Silverbrook et al. | 347/104 |
| 2011/0043582 | A1 * | 2/2011 | Silverbrook et al. | 347/104 |
| 2011/0043584 | A1 * | 2/2011 | Silverbrook et al. | 347/104 |
| 2011/0043585 | A1 * | 2/2011 | Silverbrook et al. | 347/104 |
| 2011/0043586 | A1 * | 2/2011 | Silverbrook et al. | 347/104 |
| 2011/0149004 | A1 * | 6/2011 | Ray et al. | 347/104 |

* cited by examiner

*Primary Examiner* — Geoffrey Mruk
*Assistant Examiner* — Bradley Thies
(74) *Attorney, Agent, or Firm* — Cooley LLP

(57) ABSTRACT

A continuous web printer that has an inlet for receiving a web of media from a media web roll unwinder, an outlet for delivery to a media web roll winder, an air platen frame for generating an air cushion at least partially defining a media feed path and a plurality of pagewidth inkjet printheads positioned adjacent the media feed path for printing on both sides of the web.

16 Claims, 35 Drawing Sheets

CONTINUOUS WEB PRINTER WITH AIR PLATEN

FIELD OF THE INVENTION

The invention relates to printing long rolls of media, or 'web' as it is known. In particular, the invention relates to inkjet printing of continuous web as opposed to individual sheets of media substrate.

CO-PENDING APPLICATIONS

The following applications have been filed by the Applicant simultaneously with the present application:
MWB001US MWB002US MWB003US MWB004US MWB006US MWB007US MWB008US The disclosures of these co-pending applications are incorporated herein by reference. The above applications have been identified by their filing docket number, which will be substituted with the corresponding application number, once assigned.

BACKGROUND OF THE INVENTION

Web printers are used for very high volume print runs, say greater 1000 copies but could well be more than 1 million copies for newspapers and the like. Traditionally, web printers use offset printing where plates embossed with the images and/or text are mounted on large drums that roll over the web to transfer the ink. Producing the plates and aligning the various drums for registration of each color, and for correct registration of the print of both sides of the web, is exceptionally time consuming—usually several hours. However, once set up, the web is printed at very high speeds. These are typically in the range of 3 meters per second up to 6 meters per second.

In light of the set up time, web printing becomes more efficient and cost effective as the size of the print run increases. For short print runs—say less than 1000 copies—web printing becomes uneconomical.

To address this, web printers with inkjet printheads have been developed. The Hewlett Packard® Inkjet Web Press is a thermal drop-on-demand inkjet production color printer capable of speeds of 400 linear feet per minute (approx. 2 meters per second) on webs as wide as 30 inches (0.762 m), CMYK pagewidth (or web width) printheads are duplexed to print both side of the web at an addressable 1200×600 dpi resolution. The printer price is approximately US$2.5 million and the consumable cost is about two cents for a four-color letter/A4-sized image at 30% coverage.

The inkjet web press is a digital printing process and hence there are no printing plates. This reduces the time and cost of the print run but the alignment of the printing from the printheads needs to be precise and this process remains relatively time consuming The leading edge of the web is manually fed through the press from the media roll unwinder at the input to the roll winder at the outlet by experienced technicians. The press has five main components—a print cabinet, a drying cabinet, a paper turner and aligner, a second print cabinet (for the other side of the web) and another dryer. The overall size of the press is less than a traditional offset press but still the footprint exceeds 35 $m^2$.

SUMMARY OF THE INVENTION

According to a first aspect, the present invention provides a continuous web printer comprising:

an inlet for receiving a web of media from a media web roll unwinder;

an outlet for delivery to a media web roll winder;

a media feed path extending from the inlet to the outlet; and, pagewidth inkjet printhead assemblies positioned adjacent the media feed path for printing on both sides of the web; wherein, the media feed path extends less than 10 meters from a point where during use, the web is blank, to a point where both sides of the web are printed.

Shortening the feed path significantly reduces the footprint of the web printer.

Preferably the media feed path has an upper print zone positioned above a lower print zone, the upper print zone being a section of the media feed path in which one side of the web is printed and the lower print zone being a section of the media feed path in which the other side of the web is printed. Preferably the lower print zone is less than 4 m downstream from the first print zone. Preferably the web printer occupies a footprint of floor space, the footprint being the less than 15 $m^2$ and in most cases less than 10 $m^2$.

Preferably the pagewidth inkjet printhead assemblies eject ink droplets with a volume less than 2 pico-liters. Smaller drop volumes allow the printed web to dry more quickly. Fast drying reduces the spacing between the printheads that print opposing sides of the printhead. That is, the print applied to one side of the web is dry enough for contact rollers or platens so that it can be printed on the opposing side.

Preferably the upper print zone is directly above the lower print zone. Preferably the web is fed along the media feed path in a feed direction, the feed direction in the upper print zone generally opposes the feed direction in the lower print zone. Preferably the upper print zone and the lower print zone are defined by media rollers with their axes of rotation on an arcuate path, the arcuate path of the upper print zone being vertically spaced from the arcuate path of the lower print zone such that the media feed path through the upper and lower print zones is a series of flat segments extending between adjacent rollers, such that one of the pagewidth printhead assemblies prints on each of the flat segments respectively.

Preferably the printer further comprises a printhead drawer for mounting at least one of the pagewidth inkjet printhead assemblies adjacent the media feed path; wherein, the printhead drawer is configured to move transverse to the media feed path such that the at least one pagewidth printhead assembly is exposed for servicing.

Preferably the pagewidth printhead assemblies each comprise a set of inkjet printhead modules configured for individual removal and replacement.

Preferably the printer further comprises a chassis wherein the printhead drawer is mounted to the chassis via a pair of roller bearing slides, each of the roller bearing slides having a drawer track secured to the printhead drawer, a chassis track secured to the chassis and an intermediate track positioned between the chassis track and the drawer track, such that the drawer track and the intermediate track define a draw roller bearing race and the chassis track and the intermediate track define a chassis roller bearing race.

Preferably the printer comprising two of the printhead drawers, one of the printhead drawers for mounting all the pagewidth inkjet printhead assemblies for each of the upper and lower print zones respectively.

Preferably further comprises a web threading mechanism for engaging one end of the web and threading the web along the media feed path in response to user activation. Preferably the web threading mechanism has two cable loops mounted for rotation on pulleys such that the media feed path is between the two cable loops. Preferably the printer further comprises media feed rollers configured for displacement away from the media feed path when the web threading mechanism is drawing the web to the outlet. Preferably the web threading mechanism has a web clamp that engages the free end of the unwound web, the web clamp being fixed to, and extending between the two cable loops such that synchronized rotation of the two cable loops draws the web draws the web from the input to the output.

Preferably the web is fed along the media feed path at a continuous media feed speed of 1.5 m/s to 2.0 m/s. Preferably the printer further comprises a particulate trap mounted adjacent the media feed path, the particulate trap having a vent connected to a vacuum to draw particulate contaminants off the web. Preferably the particulate trap has rotating blades for directing the particulate contaminants into the vent.

According to a second aspect, the present invention provides a continuous web printer comprising:

an inlet for receiving a web of media from a media web roll unwinder;

an outlet for delivery to a media web roll winder;

a media feed path extending from the inlet to the outlet; and, pagewidth inkjet printhead assemblies positioned adjacent the media feed path for printing on both sides of the web; wherein, the media feed path has a first print zone positioned adjacent a second print zone, the first print zone being a section of the media feed path in which one side of the web is printed and the second print zone being a section of the media feed path in which the other side of the web is printed, such that during use the web is fed along the media feed path in a feed direction, the feed direction in the first print zone being opposing the feed direction in the second print zone.

A media feed path that doubles back on itself shortens the feed path length and so reduces the printer footprint.

Preferably the media feed path extends less than 10 meters from a point where during use, the web is blank, to a point where both sides of the web are printed.

Preferably the second print zone is less than 4 m downstream along the media feed path from the first print zone.

Preferably the web printer occupies a footprint of floor space, the footprint being the less than 15 $m^2$ and in most cases less than 10 $m^2$.

Preferably pagewidth inkjet printhead assemblies eject ink droplets with a volume less than 2 pico-liters.

Preferably the first print zone is an upper print zone and the second print zone is a lower print zone positioned beneath the upper print zone. Preferably the upper print zone is directly above the lower print zone. Preferably the upper print zone and the lower print zone are defined by media rollers with their axes of rotation on an arcuate path, the arcuate path of the upper print zone being vertically spaced from the arcuate path of the lower print zone such that the media feed path through the upper and lower print zones is a series of flat segments extending between adjacent rollers, such that one of the pagewidth printhead assemblies prints on each of the flat segments respectively.

Preferably the printer further comprises a printhead drawer for mounting at least one of the pagewidth inkjet printhead assemblies adjacent the media feed path; wherein, the printhead drawer is configured to move transverse to the media feed path such that the at least one pagewidth printhead assembly is exposed for servicing. Preferably the pagewidth printhead assemblies each comprise a set of inkjet printhead modules configured for individual removal and replacement.

Preferably the printer has a chassis wherein the printhead drawer is mounted to the chassis via a pair of roller bearing slides, each of the roller bearing slides having a drawer track secured to the printhead drawer, a chassis track secured to the chassis and an intermediate track positioned between the chassis track and the drawer track, such that the drawer track and the intermediate track define a draw roller bearing race and the chassis track and the intermediate track define a chassis roller bearing race.

Preferably the printer comprises two of the printhead drawers, one of the printhead drawers for mounting all the pagewidth inkjet printhead assemblies for each of the first and second print zones respectively.

Preferably the web printer further comprises a web threading mechanism for engaging one end of the web and threading the web along the media feed path in response to user activation. Preferably the web threading mechanism has two cable loops mounted for rotation on pulleys such that the media feed path is between the two cable loops. Preferably the printer further comprises media feed rollers configured for displacement away from the media feed path when the web threading mechanism is drawing the web to the outlet. Preferably the web threading mechanism has a web clamp that engages the free end of the unwound web, the web clamp being fixed to, and extending between the two cable loops such that synchronized rotation of the two cable loops draws the web draws the web from the input to the output.

Preferably the web is fed along the media feed path at a continuous media feed speed of 1.5 m/s to 2.0 m/s. Preferably the printer further comprises a particulate trap mounted adjacent the media feed path, the particulate trap having a vent connected to a vacuum to draw particulate contaminants off the web. Preferably the particulate trap has rotating blades for directing the particulate contaminants into the vent.

According to a third aspect, the present invention provides a continuous web printer comprising:

an inlet for receiving a web of media from a media web roll unwinder;

an outlet for delivery to a media web roll winder;

a media feed path extending from the inlet to the outlet; and, pagewidth inkjet printhead assemblies positioned adjacent the media feed path for printing on both sides of the web; and, a web threading mechanism for engaging one end of the web and threading the web along the media feed path in response to user activation.

Automatically threading the web through the web printer is far safer and more time efficient than manually threading the web by hand. Outer panels and covers need not be removed to expose the rollers within which saves significant time. An automated mechanism also allows the web printers to be set up for a print run by an unskilled operator.

Preferably the web threading mechanism has two cable loops mounted for rotation on pulleys such that the media feed path is between the two cable loops. Preferably the printer has media feed rollers configured for displacement away from the media feed path when the web threading mechanism is drawing the web to the outlet.

Preferably the web threading mechanism has a web clamp that engages the free end of the unwound web, the web clamp being fixed to, and extending between the two cable loops such that synchronized rotation of the two cable loops draws the web draws the web from the input to the output. Preferably the media feed path extends less than 10 meters from a point where during use, the web is blank, to a point where both sides of the web are printed. Preferably the media feed path has an upper print zone positioned above a lower print zone, the upper print zone being a section of the media feed path in which one side of the web is printed and the lower print zone being a section of the media feed path in which the other side of the web is printed. Preferably the upper print zone is directly above the lower print zone. Preferably the lower print zone is less than 4 m downstream from the first print zone.

Preferably the web printer occupies a footprint of floor space, the footprint being the less than 15 $m^2$ and in most cases less than 10 $m^2$. Preferably pagewidth inkjet printhead assemblies eject ink droplets with a volume less than 2 picoliters.

Preferably the web is fed along the media feed path in a feed direction, the feed direction in the upper print zone generally opposes the feed direction in the lower print zone. Preferably the upper print zone and the lower print zone are defined by media rollers with their axes of rotation on an arcuate path, the arcuate path of the upper print zone being vertically spaced from the arcuate path of the lower print zone such that the media feed path through the upper and lower print zones is a series of flat segments extending between adjacent rollers, such that one of the pagewidth printhead assemblies prints on each of the flat segments respectively.

Preferably the printer further comprises a printhead drawer for mounting at least one of the pagewidth inkjet printhead assemblies adjacent the media feed path; wherein, the printhead drawer is configured to move transverse to the media feed path such that the at least one pagewidth printhead assembly is exposed for servicing.

Preferably the pagewidth printhead assemblies each comprise a set of inkjet printhead modules configured for individual removal and replacement. Preferably the printer further comprises a chassis wherein the printhead drawer is mounted to the chassis via a pair of roller bearing slides, each of the roller bearing slides having a drawer track secured to the printhead drawer, a chassis track secured to the chassis and an intermediate track positioned between the chassis track and the drawer track, such that the drawer track and the intermediate track define a draw roller bearing race and the chassis track and the intermediate track define a chassis roller bearing race.

Preferably the printer has two of the printhead drawers, one of the printhead drawers for mounting all the pagewidth inkjet printhead assemblies for each of the upper and lower print zones respectively.

Preferably the web is fed along the media feed path at a continuous media feed speed of 1.5 m/s to 2.0 m/s. Preferably the printer also has a particulate trap mounted adjacent the media feed path, the particulate trap having a vent connected to a vacuum to draw particulate contaminants off the web. Preferably the particulate trap has rotating blades for directing the particulate contaminants into the vent.

According to a fourth aspect, the present invention provides a continuous web printer comprising:

an inlet for receiving a web of media from a media web roll unwinder;

an outlet for delivery to a media web roll winder;

a media feed path extending from the inlet to the outlet;

a plurality of pagewidth inkjet printhead assemblies positioned adjacent the media feed path for printing on both sides of the web; and, a central processor for inputting print data to the pagewidth inkjet printhead assemblies such that during a print run, the pagewidth inkjet printhead assemblies print many copies of a document; wherein, the central processor is configured to selectively alter one or more of the copies to be non-identical to the remainder of the copies without interruption to the print run.

Preferably each of the pagewidth inkjet printhead assemblies has a plurality of printhead modules, each of the printhead modules having a respective print engine controller linked to the central processor, the print engine controllers each having a memory buffer for storing a portion the print data to be printed by the corresponding printhead module as well as the portion of the print data related to alterations.

Preferably the central processor is configured to load the print data and the print data related to alterations prior to the print run, and also configured to instruct the print engine controllers of each of the printhead modules to alter the print data for a non-identical copy of the document during the print run. Preferably the altered print data relates to advertising. Preferably the advertising is geographically relevant to readers of the non-identical copies of the document. Preferably the document is a publication for general sale as well as sale to subscribers and the central processor alters the document for individual subscribers in accordance with individual subscriber profiles.

Preferably the central processor is configured to access the individual subscriber profiles from a database with information related to one more of:

subscriber address;

gender;

age;

personal interests; or, purchasing history.

Preferably the printer further comprises a scanner for scanning fiducial codes along the web, the scanner being connected to the central processor for feedback control of the printhead modules. Preferably the feedback control relates to registration of printing from each of the printhead modules and timing of instructing the printhead modules to print one of the non-identical copies.

Preferably the web is fed along the media feed path at a continuous media feed speed of 1.5 m/s to 2.0 m/s. Preferably the printer has a web threading mechanism for engaging one end of the web and threading the web along the media feed path in response to user activation.

Preferably the web threading mechanism has two cable loops mounted for rotation on pulleys such that the media feed path is between the two cable loops.

Preferably the printer has media feed rollers configured for displacement away from the media feed path when the web threading mechanism is drawing the web to the outlet. Preferably the web threading mechanism has a web clamp that engages the free end of the unwound web, the web clamp being fixed to, and extending between the two cable loops such that synchronized rotation of the two cable loops draws the web draws the web from the input to the output.

Preferably the media feed path extends less than 10 meters from a point where during use, the web is blank, to a point where both sides of the web are printed.

Preferably the media feed path has an upper print zone positioned above a lower print zone, the upper print zone being a section of the media feed path in which one side of the web is printed and the lower print zone being a section of the media feed path in which the other side of the web is printed. Preferably the upper print zone is directly above the lower print zone. Preferably the lower print zone is less than 4 m downstream from the first print zone. Preferably the web printer occupies a footprint of floor space, the footprint being the less than 15 $m^2$. Preferably the pagewidth inkjet printhead assemblies eject ink droplets with a volume less than 2 picoliters.

According to a fifth aspect, the present invention provides a continuous web printer comprising:

an inlet for receiving a web of media from a media web roll unwinder;

an outlet for delivery to a media web roll winder;

an air platen frame for generating an air cushion at least partially defining a media feed path; and, a plurality of pagewidth inkjet printheads positioned adjacent the media feed path for printing on both sides of the web.

Supporting the media web on an air cushion maintains an accurate print gap between the printheads and the media web while allowing the media feed path in the print zone to be flat. Flat media feed paths across the upper and lower print zone reduces the overall height of the printer significantly. Furthermore, the flat media feed paths allow all the upper printheads to be flat relative to each other and all the lower printheads to be flat relative to each other. This simplifies manufacturing and negates the difficulties associated with accurately centering the arc of the printhead cradles over the arc of the media feed path created when feed rollers are used.

Preferably the air cushion defines a print zone, the print zone being a segment of the media feed path where, during use, one side of the web is printed, the print zone being flat. Preferably the air platen frame has a plurality of air platens, each having an air inlet and an apertured surface for generating a part of the air cushion. Preferably each of the air platens has a maintenance assembly and mounted for rotation such that the maintenance assembly is presented to one of the pagewidth printhead assemblies.

Preferably the pagewidth printhead assemblies each comprise a set of inkjet printhead modules and the maintenance assembly is a set of maintenance stations for each of the printhead modules respectively.

Preferably the printer comprises two of the air platen frames, the two air platen frames being an upper air platen frame and a lower air platen frame, the upper and lower air platen frames configured to generate air cushions defining the upper and lower print zones respectively.

Preferably the first print zone is an upper print zone and the second print zone is a lower print zone positioned vertically beneath the upper print zone.

Preferably the upper and lower air platen frames each have a plurality of air platens, each of the air platens having an air inlet and an apertured surface for generating part of the air cushion.

Preferably each of the air platens has a maintenance assembly and mounted for rotation such that the maintenance assembly is presented to one of the pagewidth printhead assemblies. Preferably the maintenance assembly is a set of maintenance stations for each of the printhead modules respectively. Preferably the web is fed along the media feed path in a feed direction, the feed direction in the upper print zone opposing the feed direction in the lower print zone.

Preferably the media feed path extends less than 10 meters from a point where during use, the web is blank, to a point where both sides of the web are printed. Preferably the lower print zone is less than 4 m downstream along the media feed path from the upper print zone.

Preferably the web printer occupies a footprint of floor space, the footprint being the less than 15 $m^2$ and commonly less than 10 $m^2$. Preferably the pagewidth inkjet printhead assemblies eject ink droplets with a volume less than 2 picoliters.

Preferably the printer further comprises a printhead drawer for mounting at least one of the pagewidth inkjet printhead assemblies adjacent the media feed path; wherein, the printhead drawer is configured to move transverse to the media feed path such that the at least one pagewidth printhead assembly is exposed for servicing.

Preferably the printer further comprises a chassis wherein the printhead drawer is mounted to the chassis via a pair of roller bearing slides, each of the roller bearing slides having a drawer track secured to the printhead drawer, a chassis track secured to the chassis and an intermediate track positioned between the chassis track and the drawer track, such that the drawer track and the intermediate track define a draw roller bearing race and the chassis track and the intermediate track define a chassis roller bearing race.

Preferably the printer comprises two of the printhead drawers, one of the printhead drawers for mounting all the pagewidth inkjet printhead assemblies for each of the first and second print zones respectively.

Preferably the printer comprises a web threading mechanism for engaging one end of the web and threading the web along the media feed path in response to user activation.

According to a sixth aspect, the present invention provides a continuous web printer comprising:

an inlet for receiving a web of media from a media web roll unwinder;

an outlet for delivery to a media web roll winder;

a media feed path extending from the inlet to the outlet;

a plurality of pagewidth printhead assemblies for printing on both sides of the web; and, a printhead drawer for mounting at least one of the pagewidth printhead assemblies adjacent the media feed path; wherein, the printhead drawer is configured to move transverse to the media feed path such that the at least one pagewidth printhead assembly is exposed for servicing.

Mounting the printhead assemblies in a drawer allows convenient removal and replacement of printheads without needing to unthread the media web, and subsequently re-thread the web through the printer.

Preferably the pagewidth printhead assemblies each comprise a set of inkjet printhead modules configured for individual removal and replacement. Preferably the printer further comprises a chassis wherein the printhead drawer is mounted to the chassis via a pair of roller bearing slides, each of the roller bearing slides having a drawer track secured to the printhead drawer, a chassis track secured to the chassis and an intermediate track positioned between the chassis track and the drawer track, such that the drawer track and the intermediate track define a draw roller bearing race and the chassis track and the intermediate track define a chassis roller bearing race.

Preferably the media feed path includes a print zone, where during use, one side of the web is printed, the print zone being defined by a set of rollers mounted with their respective axes defining an arc such that a flat feed path segment extends between each pair of adjacent rollers in the set of rollers, each of the flat feed path segments being at an angle to the adjacent flat feed path segments, and the printhead drawer mounting a number of the pagewidth printhead assemblies, such that one of the pagewidth printhead assemblies is positioned to print on one of the flat feed path segments respectively. Preferably the media feed path extends less than 10 meters from a point where during use, the web is blank, to a point where both sides of the web are printed.

Preferably the media feed path has an upper print zone positioned above a lower print zone, the upper print zone being a section of the media feed path in which one side of the web is printed and the lower print zone being a section of the media feed path in which the other side of the web is printed. Preferably the lower print zone is less than 4 m downstream from the first print zone. Preferably the web printer occupies a footprint of floor space, the footprint being the less than 15 $m^2$, and usually less than 10 $m^2$.

Preferably the pagewidth inkjet printhead assemblies eject ink droplets with a volume less than 2 pico-liters. Preferably the upper print zone is directly above the lower print zone. Preferably the web is fed along the media feed path in a feed direction, the feed direction in the upper print zone generally opposes the feed direction in the lower print zone. Preferably the upper print zone and the lower print zone are defined by media rollers with their axes of rotation on an arcuate path, the arcuate path of the upper print zone being vertically spaced from the arcuate path of the lower print zone such that the media feed path through the upper and lower print zones is a series of flat segments extending between adjacent rollers, such that one of the pagewidth printhead assemblies prints on each of the flat segments respectively.

Preferably the printer further comprises a web threading mechanism for engaging one end of the web and threading the web along the media feed path in response to user activation. Preferably the web threading mechanism has two cable loops mounted for rotation on pulleys such that the media feed path is between the two cable loops. Preferably the printer further comprises media feed rollers configured for displacement away from the media feed path when the web threading mechanism is drawing the web to the outlet.

Preferably the web threading mechanism has a web clamp that engages the free end of the unwound web, the web clamp being fixed to, and extending between the two cable loops such that synchronized rotation of the two cable loops draws the web draws the web from the input to the output.

Preferably the web is fed along the media feed path at a continuous media feed speed of 1.5 m/s to 2.0 m/s.

Preferably the printer further comprises a particulate trap mounted adjacent the media feed path, the particulate trap having a vent connected to a vacuum to draw particulate contaminants off the web. Preferably particulate trap has rotating blades for directing the particulate contaminants into the vent.

According to a seventh aspect, the present invention provides a continuous web printer comprising:

an inlet for receiving a web of media from a media web roll unwinder;

an outlet for delivery to a media web roll winder;

a media feed path extending from the inlet to the outlet; and, a plurality of pagewidth printhead assemblies for printing on both sides of the web; wherein, the media feed path has an upper print zone positioned above a lower print zone, the upper print zone being a section of the media feed path in which one side of the web is printed and the lower print zone being a section of the media feed path in which the other side of the web is printed.

Vertically stacking the print zones on each other reduces the footprint of the printer. It also removes the need for a media web 'turn bar' between the printheads that print opposite sides of the web.

Preferably the media feed path extends less than 10 meters from a point where during use, the web is blank, to a point where both sides of the web are printed. Preferably the lower print zone is less than 4 m downstream from the first print zone. Preferably the web printer occupies a footprint of floor space, the footprint being the less than 15 $m^2$, and usually less than 10 $m^2$.

Preferably the pagewidth inkjet printhead assemblies eject ink droplets with a volume less than 2 pico-liters.

Preferably the upper print zone is directly above the lower print zone. Preferably the web is fed along the media feed path in a feed direction, the feed direction in the upper print zone generally opposes the feed direction in the lower print zone. Preferably the upper print zone and the lower print zone are defined by media rollers with their axes of rotation on an arcuate path, the arcuate path of the upper print zone being vertically spaced from the arcuate path of the lower print zone such that the media feed path through the upper and lower print zones is a series of flat segments extending between adjacent rollers, such that one of the pagewidth printhead assemblies prints on each of the flat segments respectively.

Preferably the printer further comprises a printhead drawer for mounting at least one of the pagewidth inkjet printhead assemblies adjacent the media feed path; wherein, the printhead drawer is configured to move transverse to the media feed path such that the at least one pagewidth printhead assembly is exposed for servicing.

Preferably the pagewidth printhead assemblies each comprise a set of inkjet printhead modules configured for individual removal and replacement.

Preferably the printer further comprises a chassis wherein the printhead drawer is mounted to the chassis via a pair of roller bearing slides, each of the roller bearing slides having a drawer track secured to the printhead drawer, a chassis track secured to the chassis and an intermediate track positioned between the chassis track and the drawer track, such that the drawer track and the intermediate track define a draw roller bearing race and the chassis track and the intermediate track define a chassis roller bearing race.

Preferably the printer comprises two of the printhead drawers, one of the printhead drawers for mounting all the pagewidth inkjet printhead assemblies for each of the upper and lower print zones respectively.

Preferably the printer further comprises a web threading mechanism for engaging one end of the web and threading the web along the media feed path in response to user activation. Preferably the web threading mechanism has two cable loops mounted for rotation on pulleys such that the media feed path is between the two cable loops. Preferably the printer further comprises media feed rollers configured for displacement away from the media feed path when the web threading mechanism is drawing the web to the outlet. Preferably the web threading mechanism has a web clamp that engages the free end of the unwound web, the web clamp being fixed to, and extending between the two cable loops such that synchronized rotation of the two cable loops draws the web draws the web from the input to the output.

Preferably the web is fed along the media feed path at a continuous media feed speed of 1.5 m/s to 2.0 m/s.

Preferably the printer further comprises a particulate trap mounted adjacent the media feed path, the particulate trap having a vent connected to a vacuum to draw particulate contaminants off the web. Preferably the particulate trap has rotating blades for directing the particulate contaminants into the vent.

According to an eighth aspect, the present invention provides a continuous web printer comprising:

an inlet for receiving a web of media from a media web roll unwinder;

an outlet for delivery to a media web roll winder;

a plurality of pagewidth inkjet printhead assemblies for printing on both sides of the web; and, a media feed path extending from the inlet to the outlet, the media feed path having a first print zone where, during use, one side of the web is printed and a second print zone where, during use, the other side of the web is printed; wherein, the first print zone and the second print zone are flat, and the first print zone is upstream from the second print zone with respect to a media feed direction.

Flat upper and lower print zones reduce the overall height of the printer significantly. Furthermore, the flat media feed paths allow all the upper printheads to be flat relative to each other and all the lower printheads to be flat relative to each other. This simplifies manufacturing and negates the difficulties associated with accurately centering the arc of the printhead cradles over an arc of the media feed path created when feed rollers are used.

Preferably the first print zone is an upper print zone and the second print zone is a lower print zone positioned vertically beneath the upper print zone. Preferably the printer further comprises an upper air platen frame and a lower air platen frame, the upper and lower air platen frames configured to generate air cushions defining the upper and lower print zones respectively. Preferably the upper and lower air platen frames each have a plurality of air platens, each of the air platens having an air inlet and an apertured surface for generating part of the air cushion. Preferably each of the air platens has a maintenance assembly and mounted for rotation such that the maintenance assembly is presented to one of the pagewidth printhead assemblies.

Preferably the pagewidth printhead assemblies each comprise a set of inkjet printhead modules and the maintenance assembly is a set of maintenance stations for each of the printhead modules respectively. Preferably the web is fed along the media feed path in a feed direction, the feed direction in the first print zone being opposing the feed direction in the second print zone.

Preferably the media feed path extends less than 10 meters from a point where during use, the web is blank, to a point where both sides of the web are printed. Preferably the second print zone is less than 4 m downstream along the media feed path from the first print zone. Preferably the web printer occupies a footprint of floor space, the footprint being the less than 15 $m^2$, and commonly less than 10 $m^2$. Preferably the pagewidth inkjet printhead assemblies eject ink droplets with a volume less than 2 pico-liters.

Preferably the printer further comprises a printhead drawer for mounting at least one of the pagewidth inkjet printhead assemblies adjacent the media feed path; wherein, the printhead drawer is configured to move transverse to the media feed path such that the at least one pagewidth printhead assembly is exposed for servicing.

Preferably the pagewidth printhead assemblies each comprise a set of inkjet printhead modules configured for individual removal and replacement. Preferably the printer further comprises a chassis wherein the printhead drawer is mounted to the chassis via a pair of roller bearing slides, each of the roller bearing slides having a drawer track secured to the printhead drawer, a chassis track secured to the chassis and an intermediate track positioned between the chassis track and the drawer track, such that the drawer track and the intermediate track define a draw roller bearing race and the chassis track and the intermediate track define a chassis roller bearing race. Preferably the printer comprises two of the printhead drawers, one of the printhead drawers for mounting all the pagewidth inkjet printhead assemblies for each of the first and second print zones respectively.

Preferably the printer further comprises a web threading mechanism for engaging one end of the web and threading the web along the media feed path in response to user activation. Preferably the web threading mechanism has two cable loops mounted for rotation on pulleys such that the media feed path is between the two cable loops. Preferably the upper and lower air platen frames are configured for displacement away from the media feed path when the web threading mechanism is drawing the web to the outlet. Preferably the web threading mechanism has a web clamp that engages the free end of the web, the web clamp being fixed to, and extending between the two cable loops such that synchronized rotation of the two cable loops draws the web draws the web from the input to the output.

BRIEF DESCRIPTION OF THE DRAWINGS

The invention will now be described by way of example only with reference to the accompanying drawings in which.

DETAILED DESCRIPTION OF THE PREFERRED EMBODIMENTS

Overview

Figure 1:
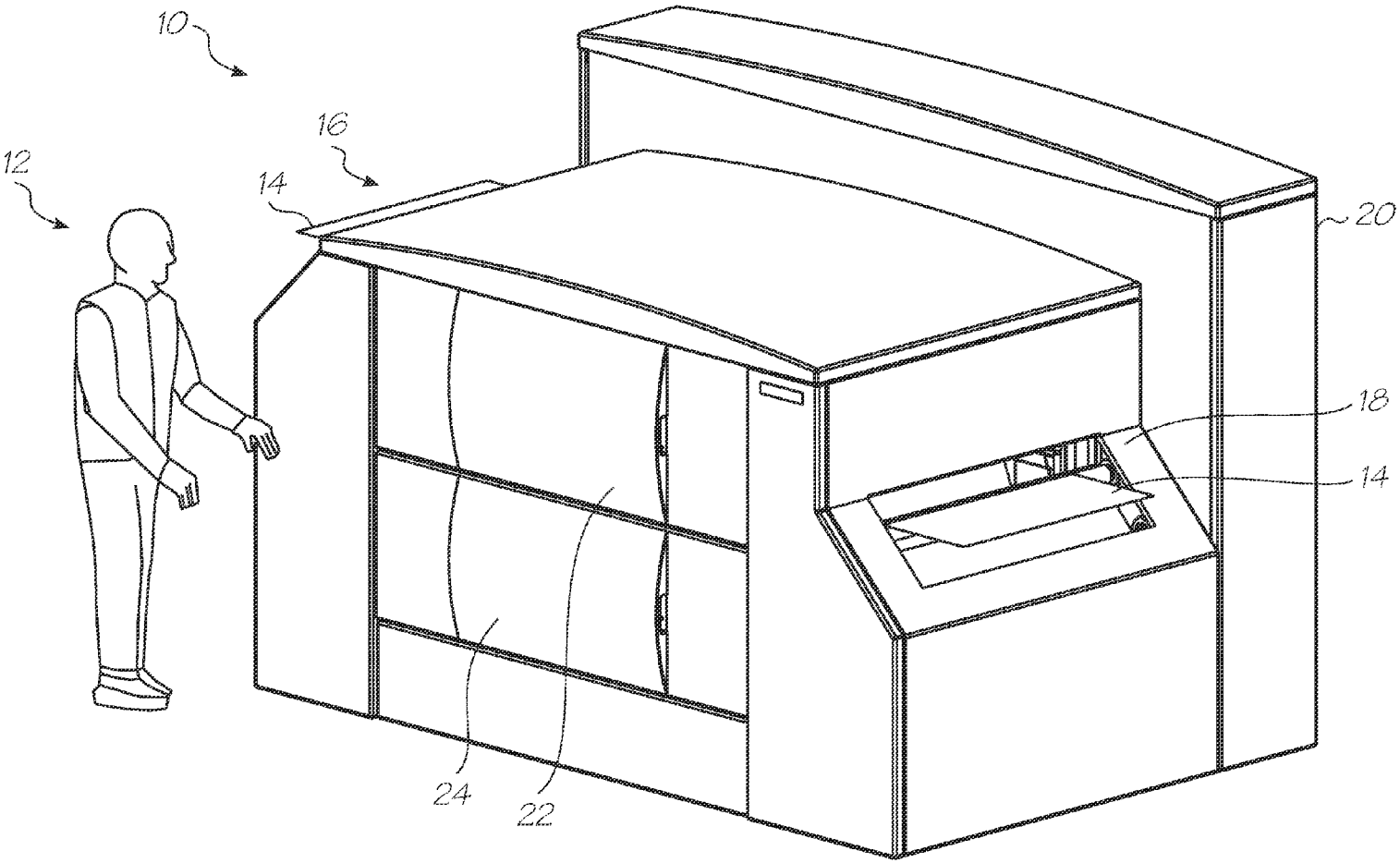
FIG. 1 shows a perspective of a continuous web printer according to the invention together with a person to indicate overall size and dimensions.
Figure 2:
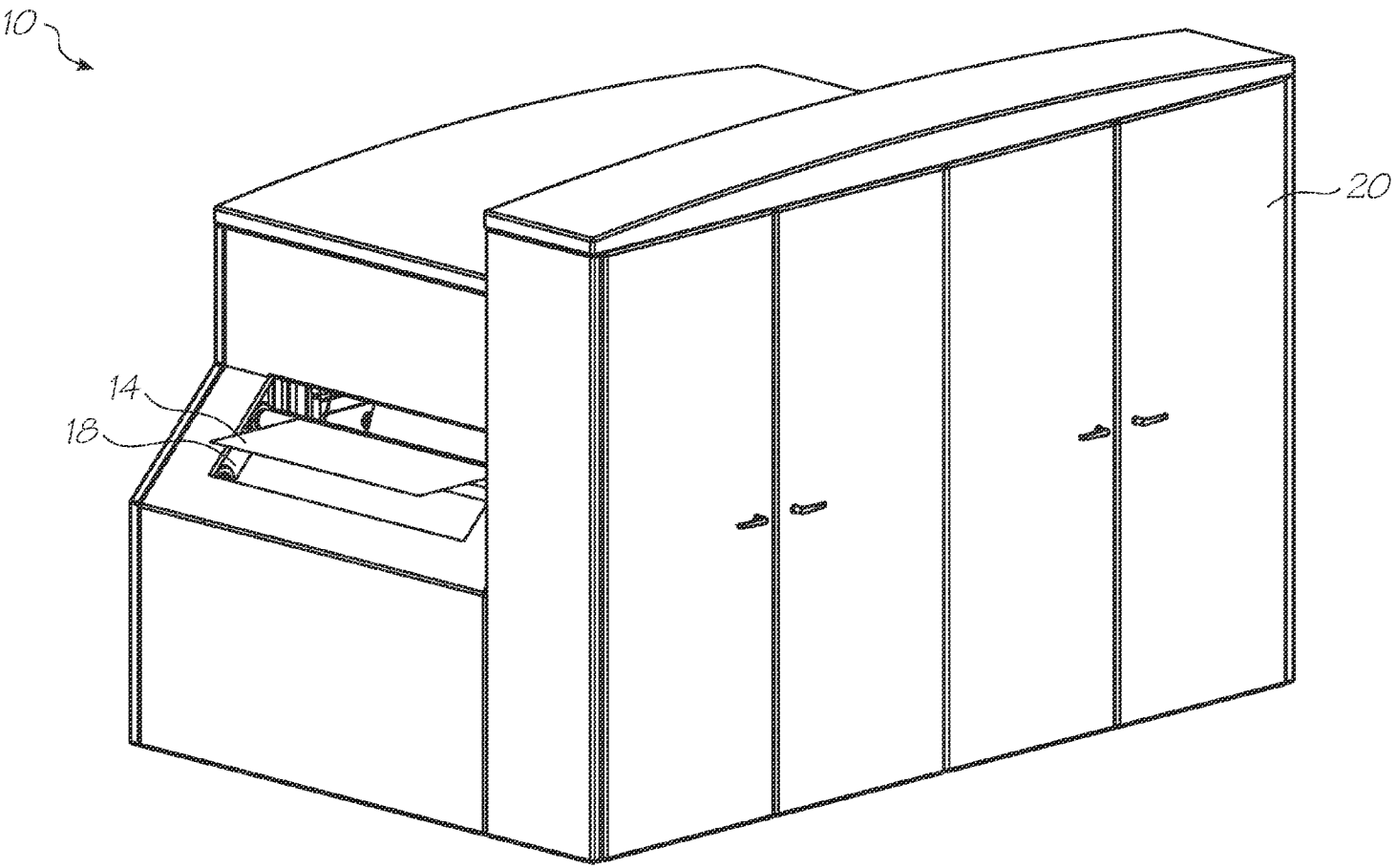
FIG. 2 shows a reverse perspective of the web printer shown in FIG. 1.

FIG. 1 shows the continuous web printer 10 next to a person 12 for context as to the printer size and footprint. A continuous web of media 14 is fed from a web roll unwinder (not shown) into the web inlet 16, through the printer 10 to the web outlet 18 where it is collected by a web roll winder (not shown). Web winders and unwinders are widely used and well known in the industry (see for example U.S. Pat. No. 5,178,341). On the front of the printer 10 are two removable panels 22 and 24 concealing the upper and lower printhead assembly drawers (described below). FIG. 2 shows the ink tanks and control processor storage cabinets 20 at the rear of the printer 10.

Figure 3:
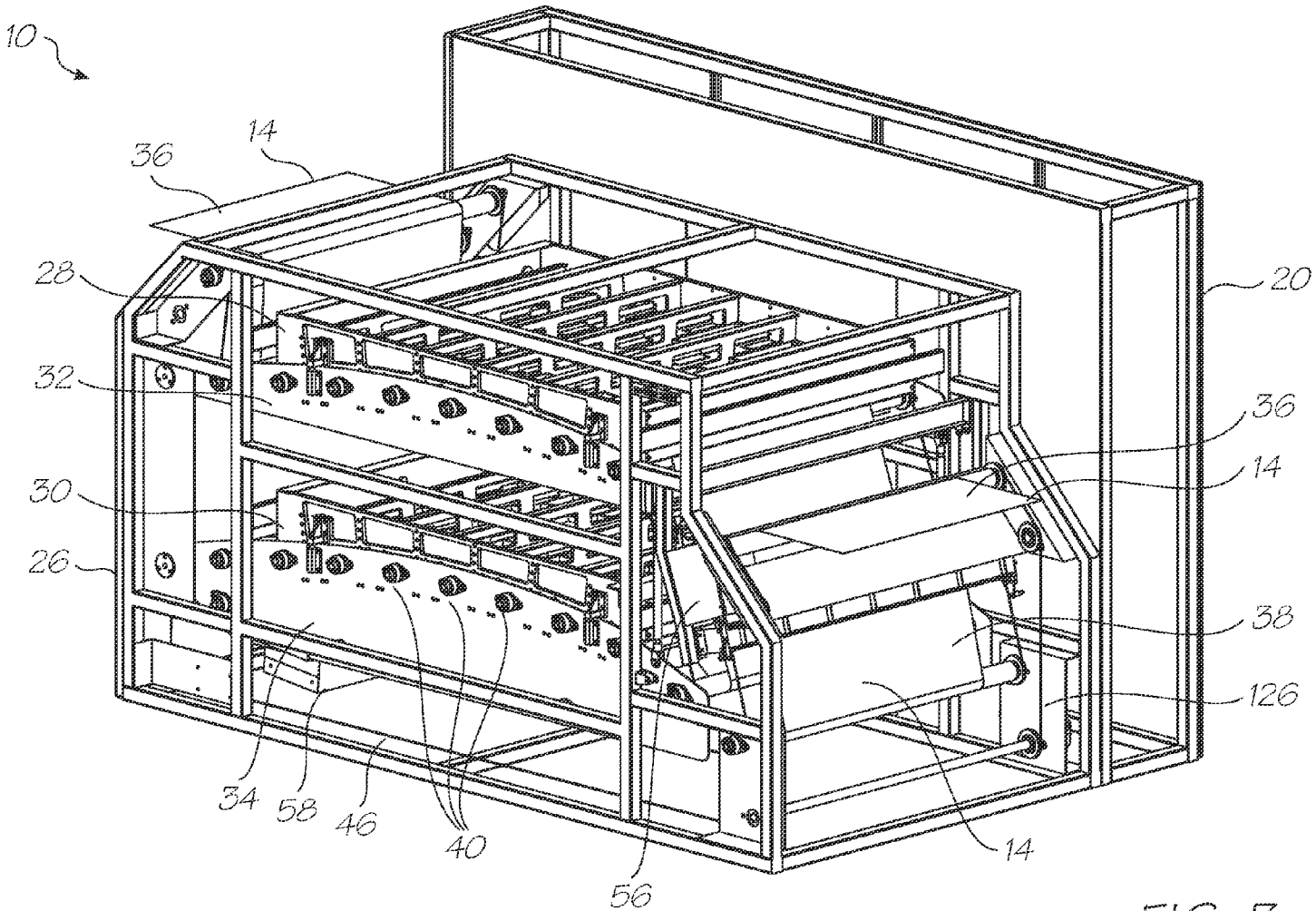
FIG. 3 is the perspective of FIG. 1 with the exterior panels removed.

FIG. 3 shows the interior of the printer 10 with the outer paneling removed. The printer chassis 26 supports an upper printhead drawer 28 and a lower printhead draw 30. The upper printhead drawer 28 prints on the first side 36 of the media web 14 and the lower printhead drawer prints on the second side 38 of the media web 14. Beneath the upper printhead drawer 28 is the upper roller frame 32 and similarly the lower roller frame 34 sits beneath the lower printhead drawer 30. The roller frames mount a series of rollers 40 for defining the media feed path adjacent the pagewidth printhead assemblies (described below).

Pagewidth Inkjet Printhead Assemblies

Figure 17A:
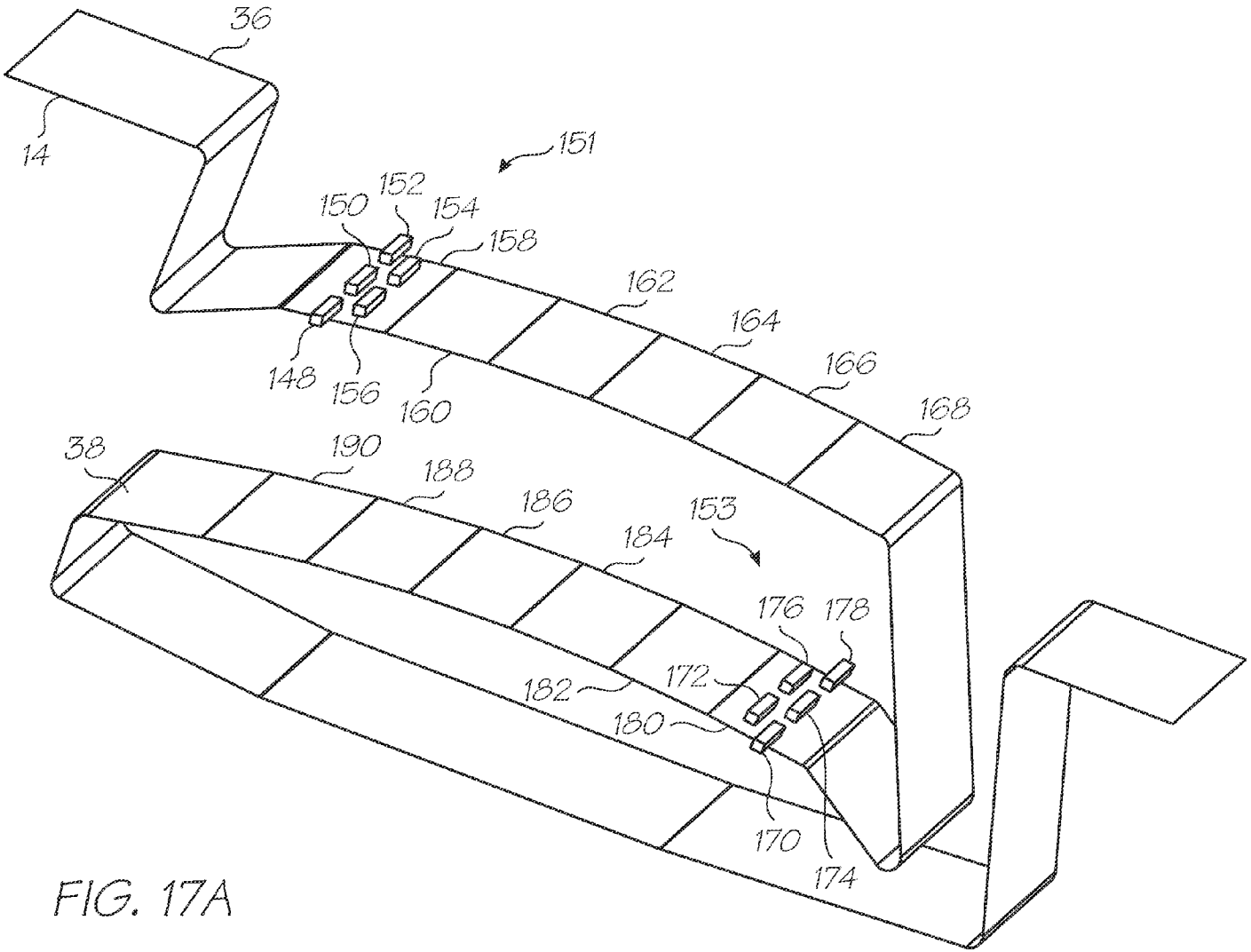
FIG. 17A is a perspective of a length of media web configured in the shape of the media feed path.

The pagewidth inkjet printhead assemblies 151 and 143 are shown schematically in FIG. 17A for the purposes of illustration. Each assembly has five printhead modules (e.g. 148, 150, 152, 154 and 156) extending the width of the media web 14. The printhead modules are a user replaceable component of the printer and a comprehensive description of their structure and operation is provided in U.S. Ser. No. 12/845,723 filed Jul. 29, 2010 the contents of which are incorporated herein by reference. This co-pending application is also a useful reference for a detailed description of the maintenance stations 90 shown schematically in FIG. 17B. The printhead modules disclosed in U.S. Ser. No. 12/339,039 filed Dec. 19, 2008 are also very similar to the modules used in the continuous web printer described here, hence the contents of this are also incorporated herein by reference.

Automated Web Feed

Figure 4A:
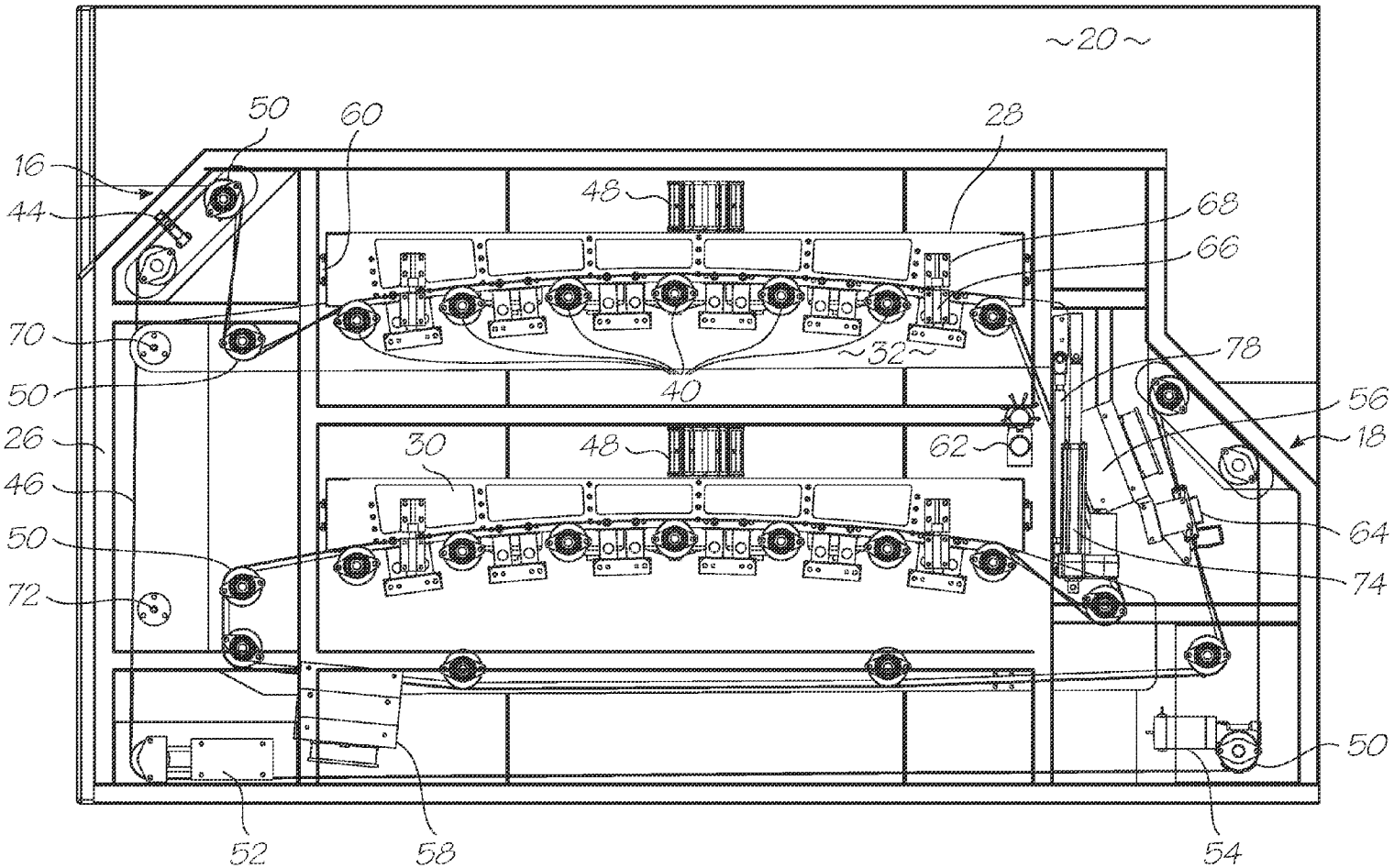
FIG. 4A is an elevation of the internal features of the front of the printer.
Figure 4B:
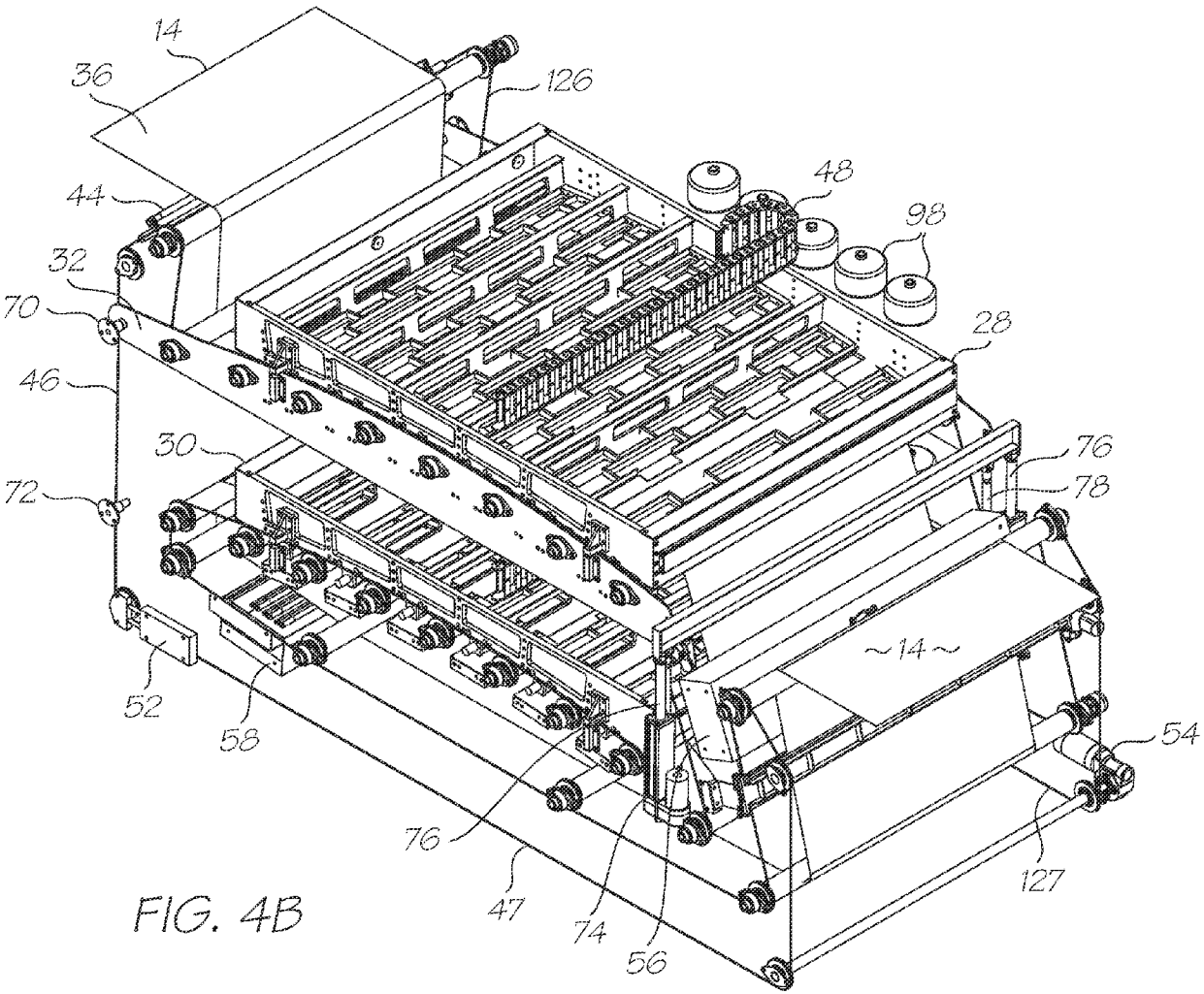
FIG. 4B is a perspective of the internal features of the printer with the chassis removed for clarity.
Figure 12B:
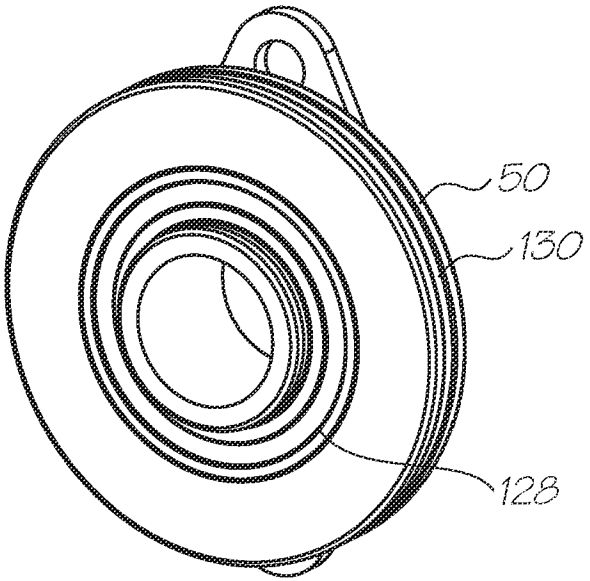
FIGS. 12A and 12B are perspectives of the cable roller for the media web feed assembly.
Figure 12A:
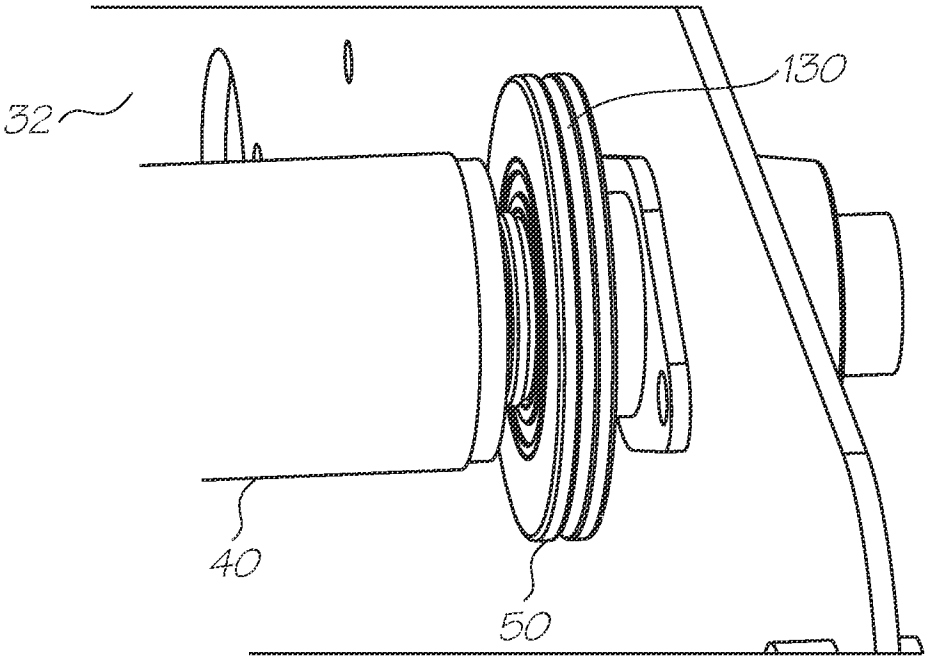

FIGS. 4A and 4B shows the internal features of the printer in greater detail. For clarity, FIG. 4B has removed the chassis 26. The chassis 26 supports two cable loops 46 and 126 on a series of cable pulleys 50. FIGS. 12A and 12B show the cable pulleys 50 in greater detail. The cable pulleys each have a peripheral groove 130 to retain the cables 46 and 126. Each pulley 50 is mounted for independent rotation on a roller bearing 128. Hence the pulleys 50 at either end of the media rollers 40 (see FIG. 12A) rotate independently of the roller.

Figure 15:
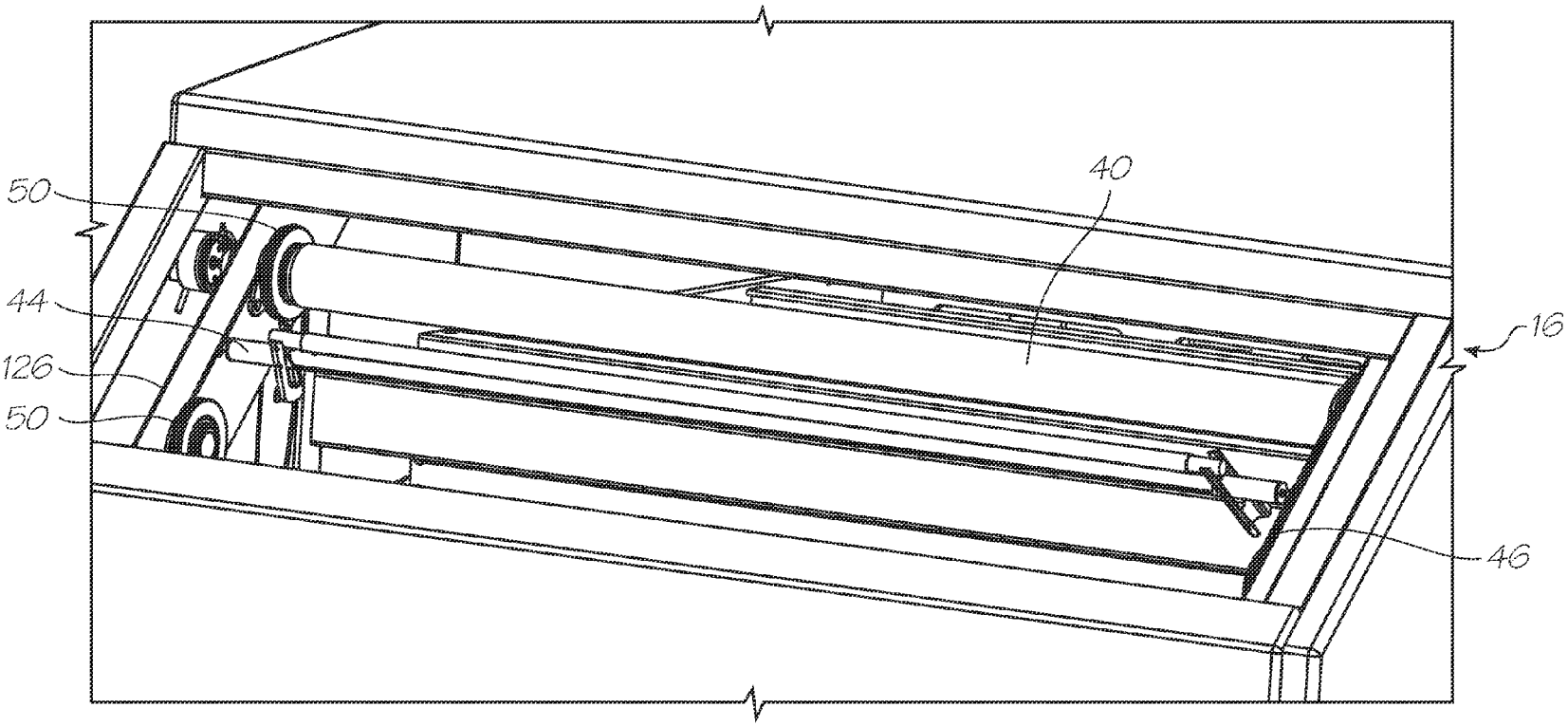
FIG. 15 is a perspective of the web clamp at the inlet to the printer.

FIGS. 4A, 4B, 13, 14, 15 and 16A to 16C best show the operation of the web clamp. Referring firstly to FIG. 15, the web clamp 44 is fixed to, and extends between the cable loops 46 and 126. When not in use, the web clamp 44 'parks' at the web inlet 16. To thread the media web through the printer, the web from the roll unwinder is gripped by the web end clamp 44 which is then driven on the cable loops along the media feed path to the web outlet 18. (see FIG. 1). The web is removed from the web clamp 44 and manually taken to the roll winder (not shown). As best shown in FIG. 4B, the web clamp 44 returns to the web inlet 16 via the return sections (47 and 127 respectively) of the cable loops 46 and 126. A cable drive motor 54 (see FIG. 13) synchronously rotates the loops and cable tensioners 52 (see FIG. 14) maintain correct cable tension in each loop.

Figure 16A:
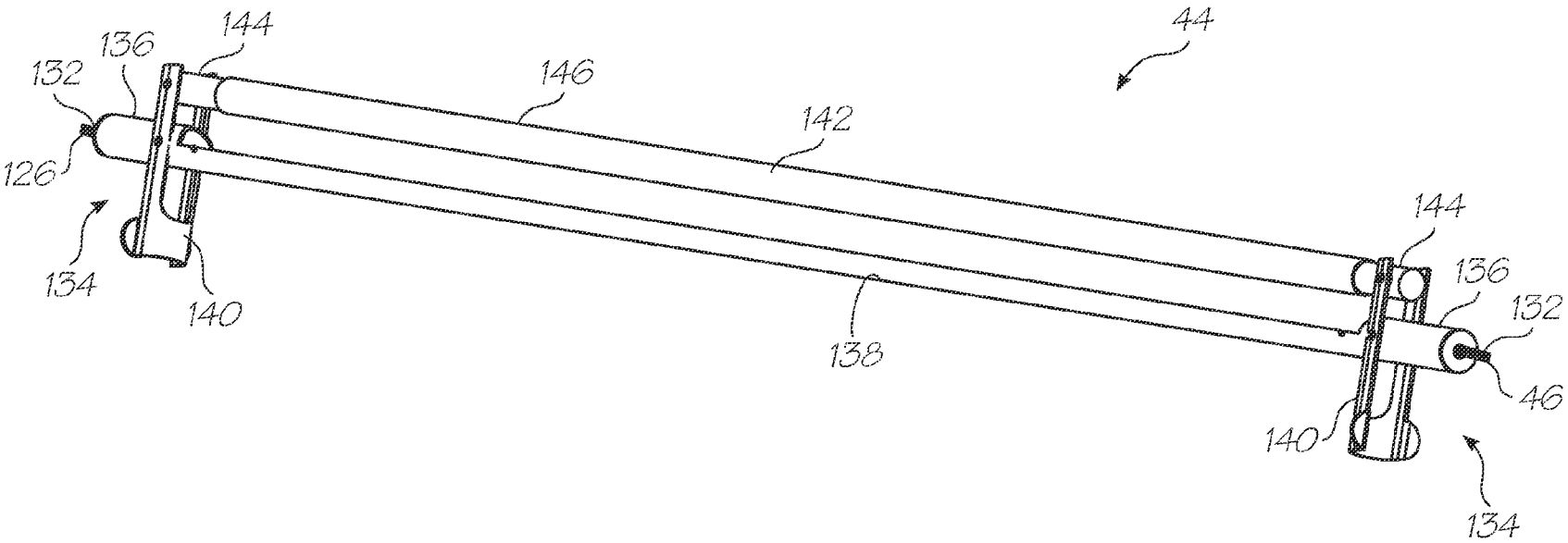
FIG. 16A is a perspective of the web clamp with the clamp bar and over centre mechanisms in an open configuration.
Figure 16B:
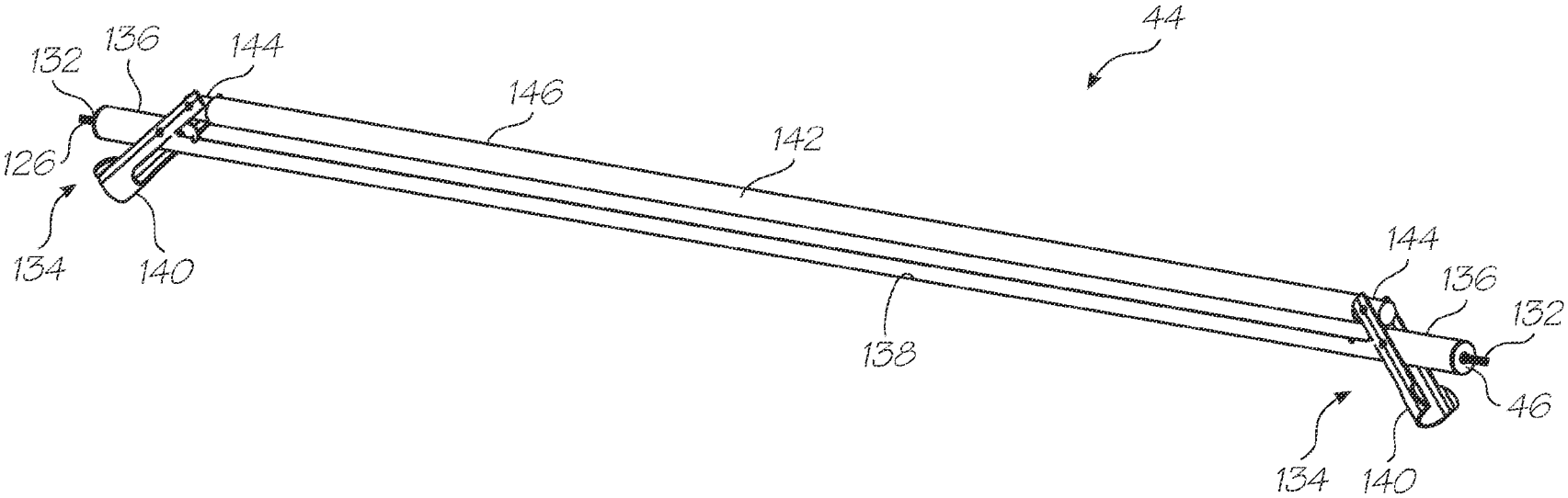
FIG. 16B is a perspective of the web clamp with the clamp bar closing under the bias of the over centre mechanisms.
Figure 16C:
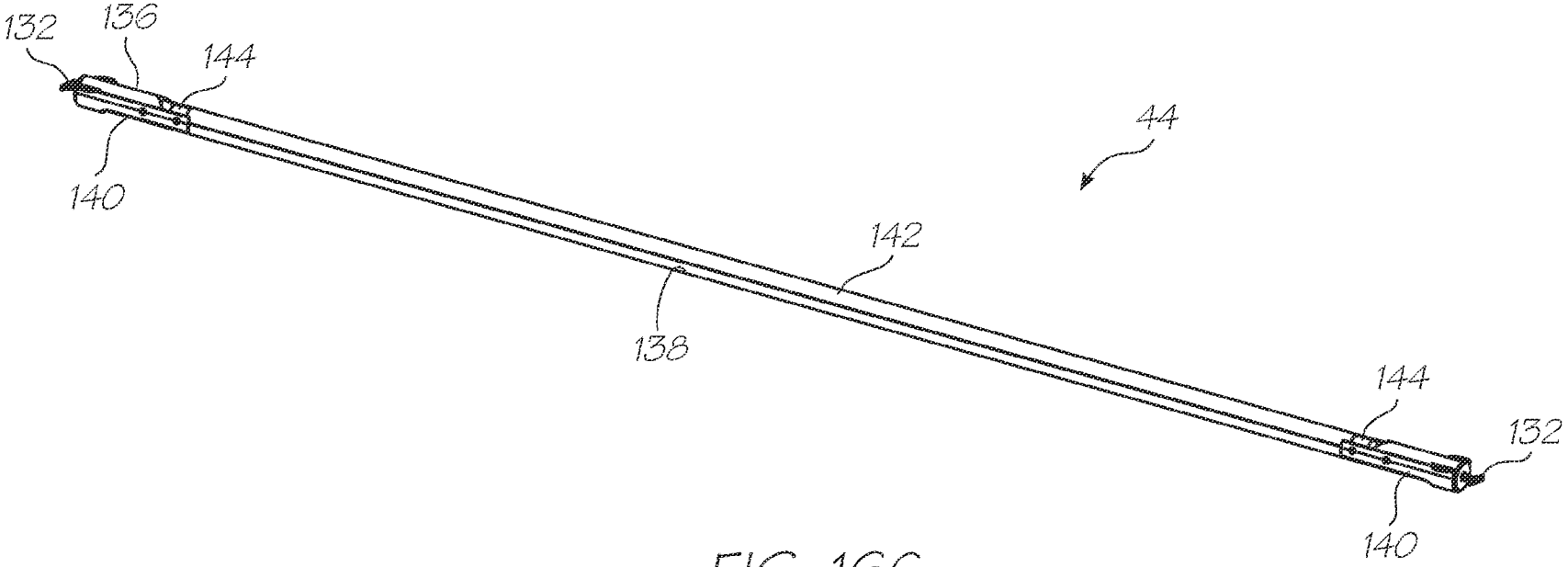
FIG. 16C is a perspective of the web clamp with the clamp bar in the clamped position.

FIGS. 16A to 16C show the web clamp 44 in isolation. A clamp arm 136 is rigidly secured to each of the cable loops 46 and 126 via cable clamps 132 extending from either end. Adjacent each end is an over centre mechanism 134 for biasing the clamp bar 146 into engagement with a central trough in the clamp arm 136. The over centre mechanisms 134 each have a lift lever 140 hinged to the clamp arm 136. The lever end is hinged to spring loaded telescopic ends 144 that can compress into the sleeve 142 against the bias of the springs. In FIG. 16A, the clamp 44 is open with the clamp bar 146 spaced from the longitudinal trough 138. The clamp bar 146 is at its maximum length with the springs in the telescopic ends 144 uncompressed. The extended clamp bar 146 holds itself spaced from the clamp arm 138 so that the user's hands are free to hold the end of the web media 14. The media web 14 is placed between the clamp bar 146 and the arm 136 and the lift levers 140 are rotated to close the gap (see FIG. 16B). The lift levers 140 rotate past the balance point of each over center mechanism 134 such that when the rubberized sleeve 142 of the clamp bar 146 nests into the trough 138 of the clamp arm 136, the bias from the sprung telescopic ends 144 urges the clamp bar 146 and the clamp arm 136 together (see FIG. 16C). This grips the media web 14 (see FIG. 3) as the web clamp 44 is fed from the web inlet 16 to the web outlet 18.

Roller Frame Movement

Figure 7A:
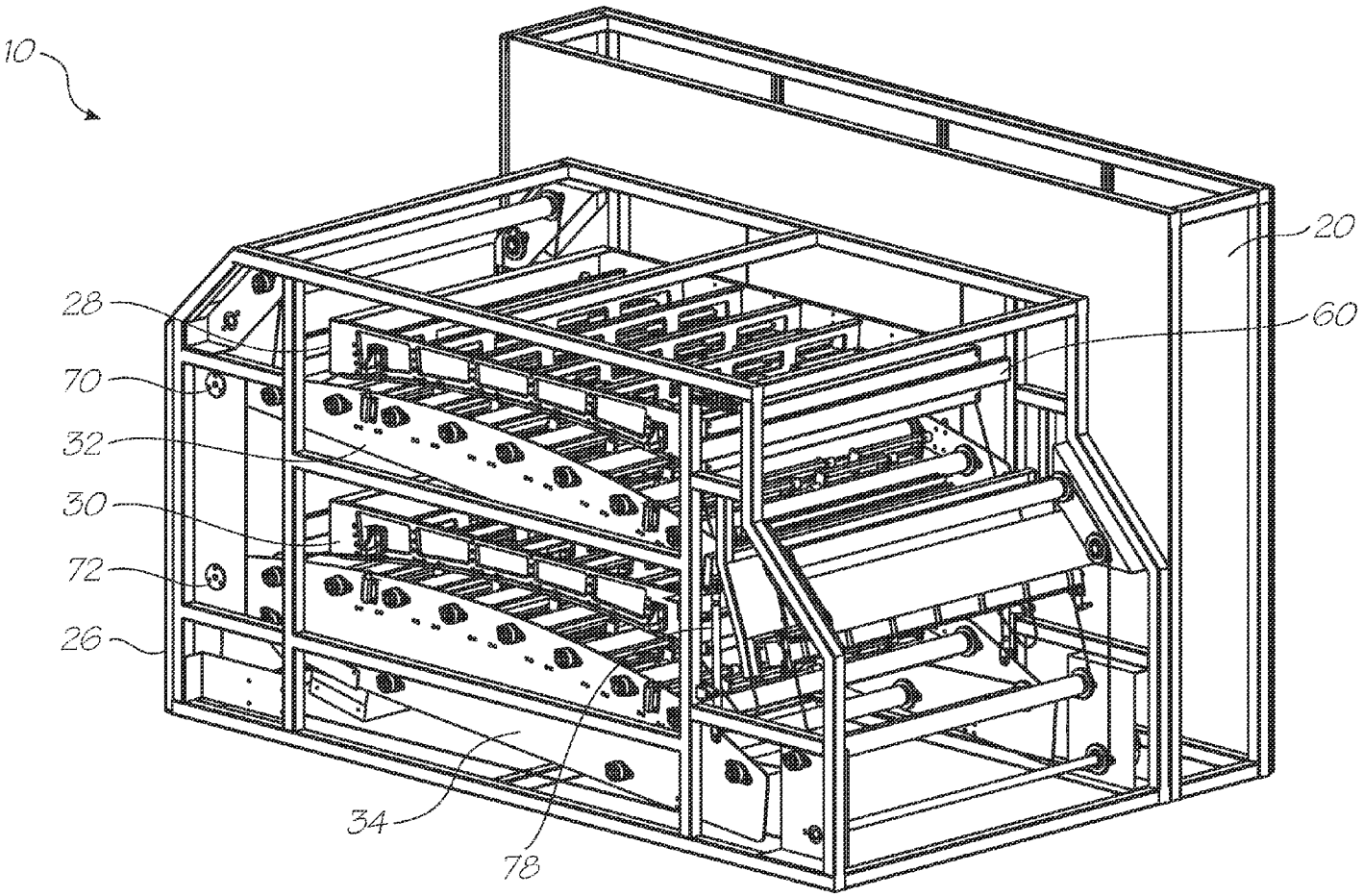
FIG. 7A is a perspective of the printer with the upper and lower roller frames in the lowered position.
Figure 7B:
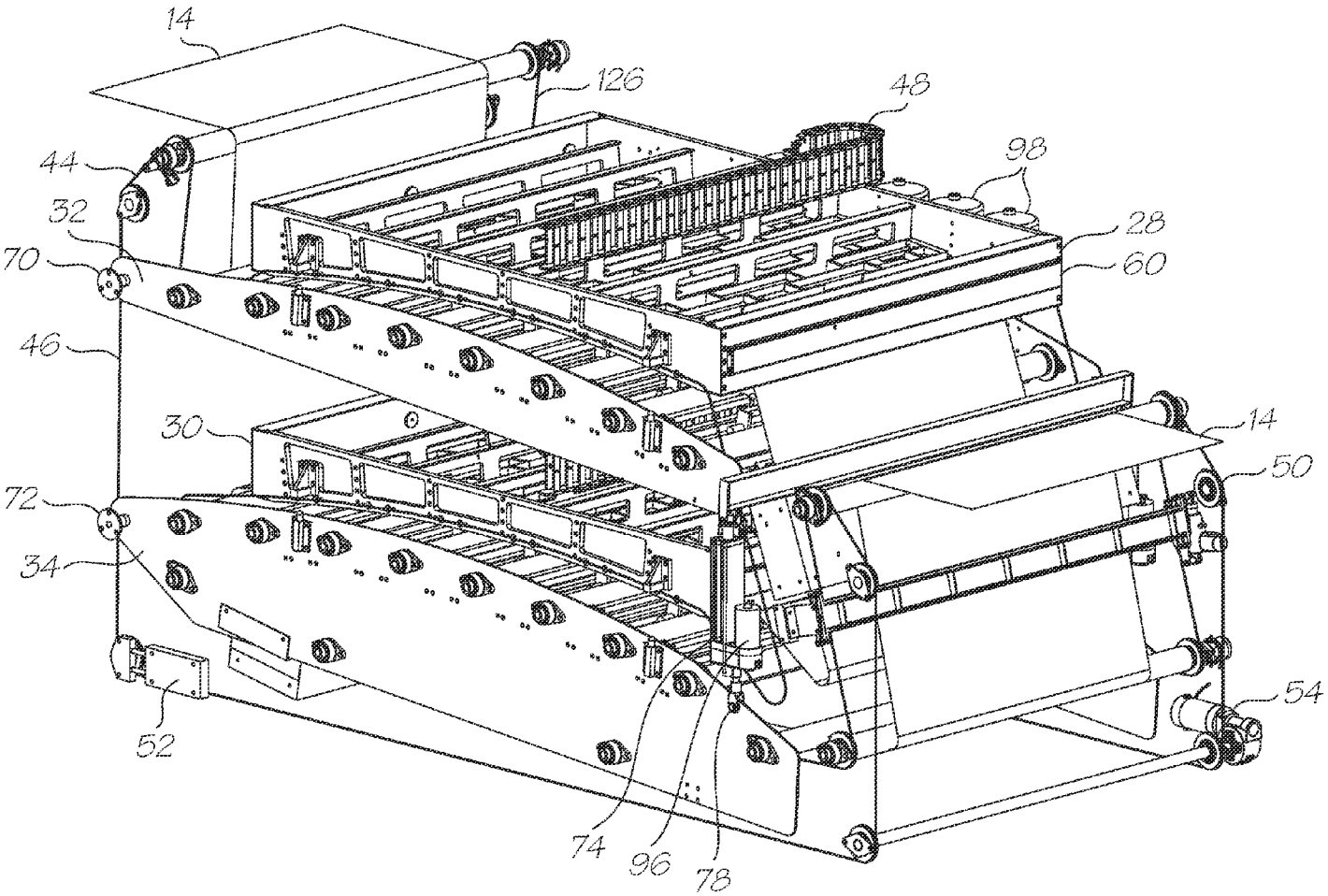
FIG. 7B is a perspective with the upper and lower roller frames in the lowered position and the chassis removed for clarity.
Figure 11:
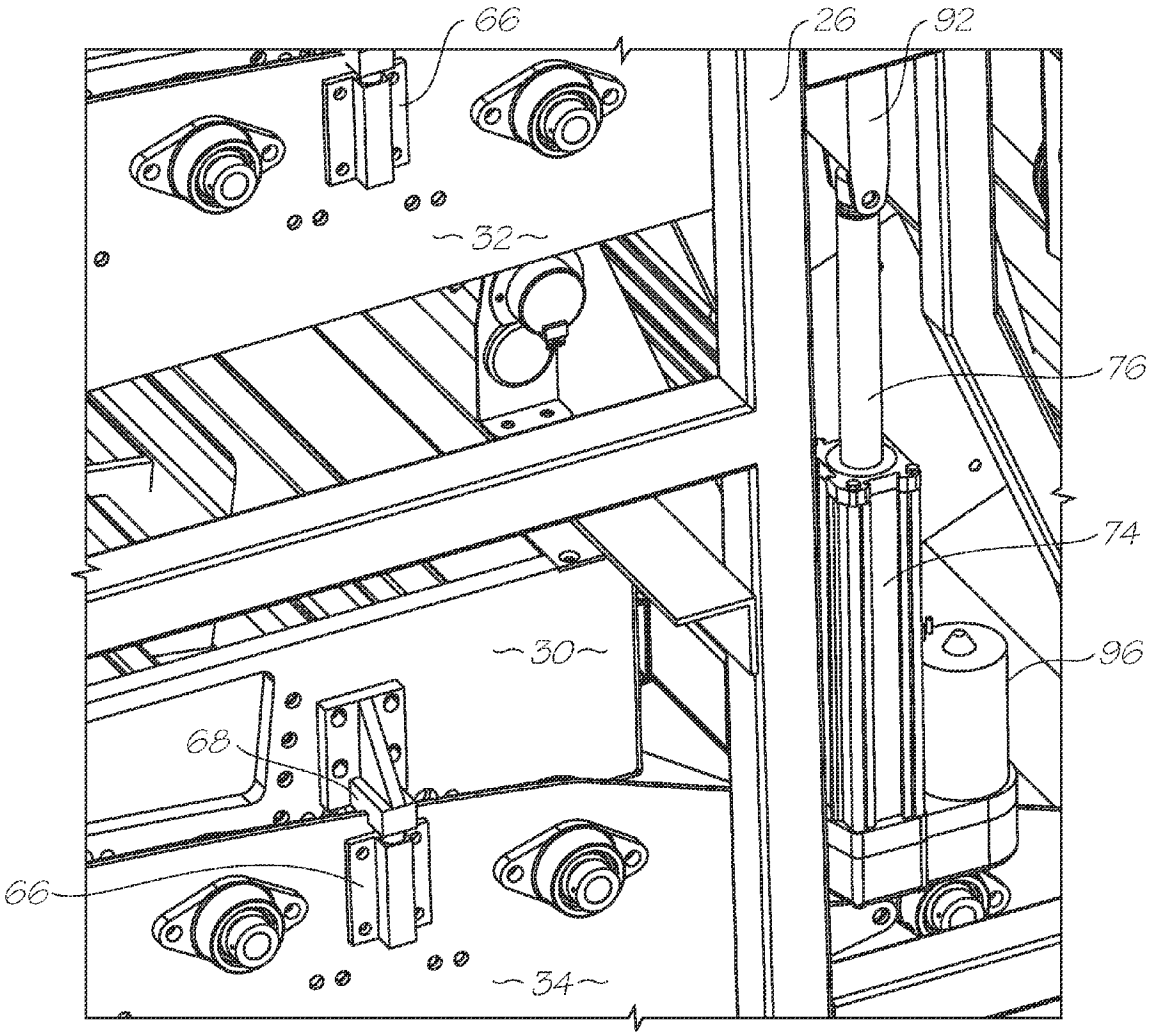
FIG. 11 is an enlarged perspective of the lifting and lowering mechanism for the upper and lower roller frames.

Referring to FIGS. 7A and 7B, the upper and lower roller frames 32 and 34 are mounted to the pivot downwards and away from the upper and lower printhead assembly drawers 28 and 30 respectively. The roller frames 32 and 34 are pivoted away from the printhead assembly drawers 28 and 30 to allow the media web to be threaded through the media feed path. Referring to FIG. 11, the jacking mechanism 74 retracts the extendible strut 76 and as the upper roller frame 32 lowers, so too does lower roller frame 34 which is joined to the upper roller frame by connecting rod 78. Lowering the roller frames increases the gap between the media rollers and the printhead drawers to allow clearance for the web end clamp 44 to pass through. When the web is threaded through the printer, the jacking mechanism 74 extends the strut 76 and the roller frames rotate up to the printhead drawers about the upper and lower hinges 70 and 72 respectively.

The gap between the printheads and the media web (known as 'the printing gap') needs to be closely controlled to maintain print quality. To keep the print gap within specified tolerances, both the upper and lower roller frames (32 and 34)

have four registration pins 66 each. These metal pins are precisely located relative to the axes of the media rollers 40. Opposing the registration pins 66 are corresponding datum surfaces 68 on the upper and lower printhead drawers (28 and 30). The datum surfaces 68 are precisely located relative to the feed rollers 40 and likewise the registration pins 66 are accurately positioned relative to the printhead assemblies 151 and 153 (see FIG. 17A).

As shown in FIG. 11, the roller frames 32 and 34 move up to the printhead drawers 28 and 30. The registration pins 66 on the lower roller frame engage the datum surfaces 66 on the lower printhead drawer 34 before the registration pins 66 of the upper roller frame 32 engage the datum surfaces 68 on the upper printhead drawer 28. This happens because the connecting rod 78 is resiliently extendible using a spring loaded telescopic assembly. When the roller frames are in the lowered position, the connecting rod is shorter than the distance between a datum surface on the upper printhead drawer and the corresponding datum surface on the lower printhead drawer directly beneath. The extendible strut 76 forces the registration pins 66 on the upper roller frame 32 into engagement with the datum surfaces 68 against the bias of the sprung connecting rod 78. Likewise the lower roller frame 34 is held firmly in place by the bias of the spring in the connecting rod 78.

Printhead Drawer Self Centering Roller Slides

The printing gap 198 (see FIG. 17B) is also affected by the precision with which the arc of the printheads is centered over the arc of the media rollers 40. Skilled workers will appreciate that the rollers in the print zones (the zones where ink drops strike the media web) are arranged in an arc for control of the printing gap. The media web 14 is less likely to lift away from the surface of the rollers if the web is tensioned across an arc of rollers. Lifting away from the rollers would narrow or close the printing gap and produce artifacts in the print.

With the media web fed over an arc of rollers, the printheads need to be mounted in a parallel arc that is precisely centered over the arc of the rollers. This is trivial when the printhead assemblies, or at least the printhead module mounting sites are fixed relative to the media rollers. However, the printer 10 has pagewidth printhead assemblies mounted in draws that slide relative to the chassis for ease of removing and replacing faulty printheads. To keep the upper and lower printhead drawers 28 and 30 centered, they are mounted to the chassis 26 on roller bearing slides 60.

Figure 10:
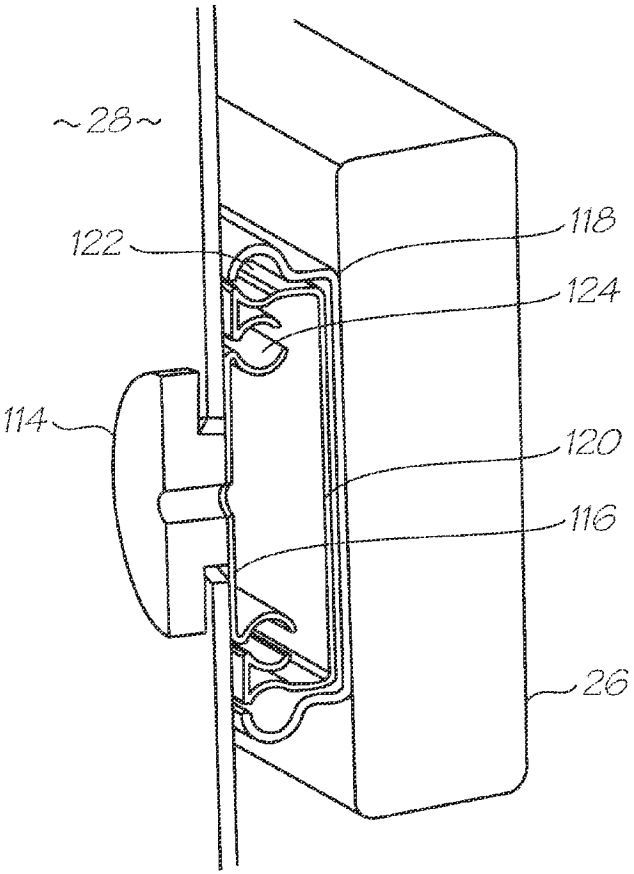
FIG. 10 is an enlarged sectioned perspective of the self centering slides of the upper and lower printhead draws.

FIG. 10 shows the roller bearing slides 60 in detail. A drawer track 116 is mounted to the side of the drawer frame 80 with spaced swaged head fasteners 114. The drawer track 116 and an intermediate track 120 cooperate to form a drawer roller bearing race 124 for ball bearings (not shown). A chassis track 118 is fixed to the chassis 26 and cooperates with the intermediate track 120 to form a chassis bearing race 122 for another set of ball bearings. The drawer track 116 slides relative to the intermediate track 120 which in turn slides relative to the chassis track 118 when the printhead drawer 28 or 30 is drawn out from the printer chassis 26. The curved bearing races 122 and 124 accurately centre on the ball bearings so that the printhead drawers are likewise centered over the arc of the roller frame 32 or 34.

Energy Chains

Referring back to FIGS. 4A and 4B, all the electrical cabling to the printheads and their respective print engine controllers is fed from the main processor in the cabinets 20 through caterpillar track style energy chains 48. The energy chains 48 unfurl as the upper and lower printhead drawers 28 and 30 are pulled out from the chassis 26. This keeps the many wires tidy and prevents them from jamming in the draws or other damage.

Printhead Drawers

Figure 5:
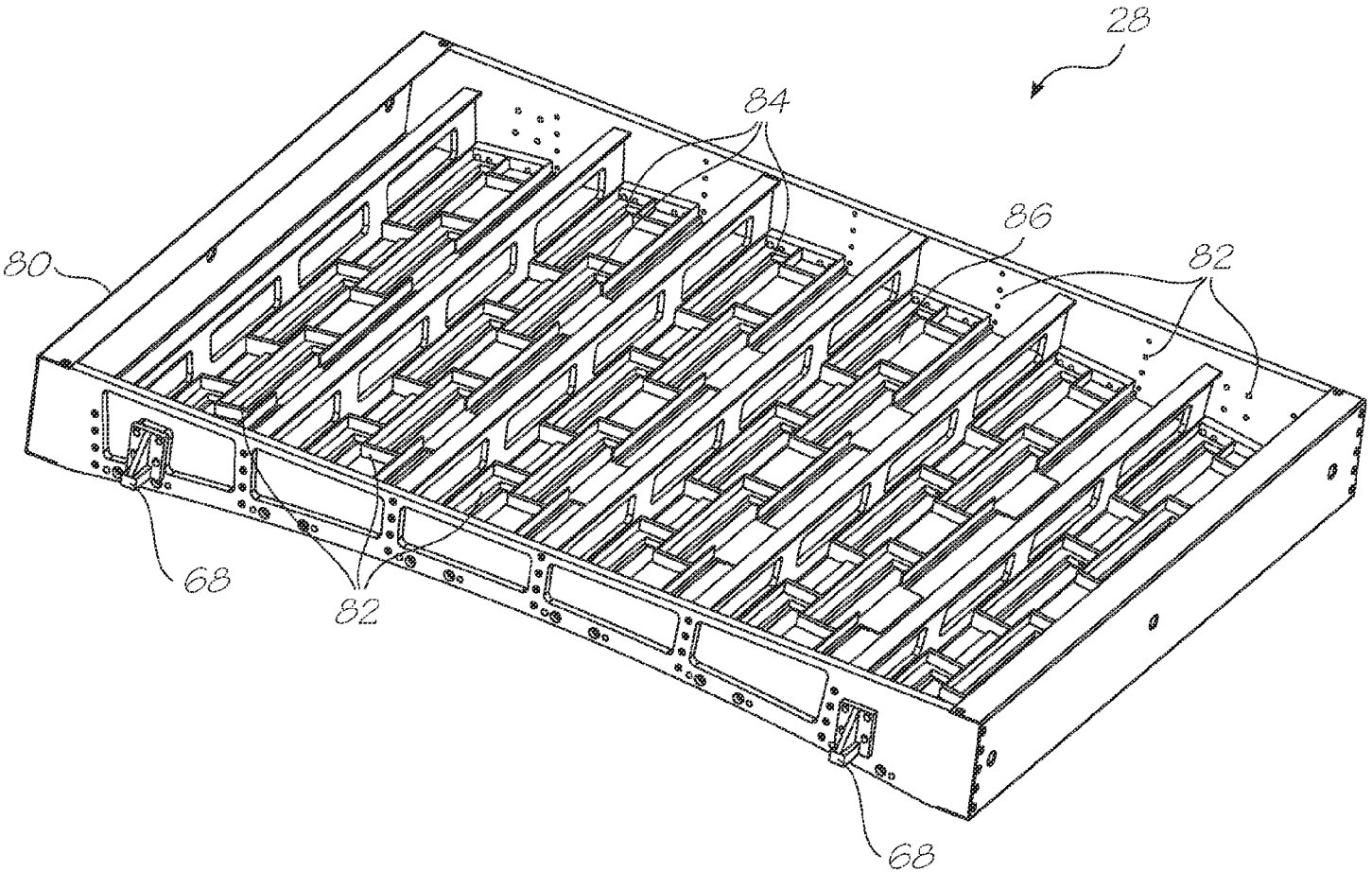
FIG. 5 is an elevation of the printhead drawer in which the six pagewidth printhead assemblies are mounted.

FIG. 5 shows the upper printhead drawer 28 in isolation. The drawer has a drawer frame 80 for mounting six printhead cradles 82 at an angle to each other. Each printhead cradle 82 has mounting sites 84 for five separate printhead modules (described in greater detail below with reference to FIG. 17A). The printhead modules in a single printhead cradle 82 form one of the pagewidth printhead assemblies 151 (see FIG. 17A) and each pagewidth printhead assembly prints one color channel only (CMYK or IR). Hence the printer may configure the six printhead cradles 82 to print CCMMYK or CMYKKIR or a different combination better suited to the intended print jobs.

Figure 29:
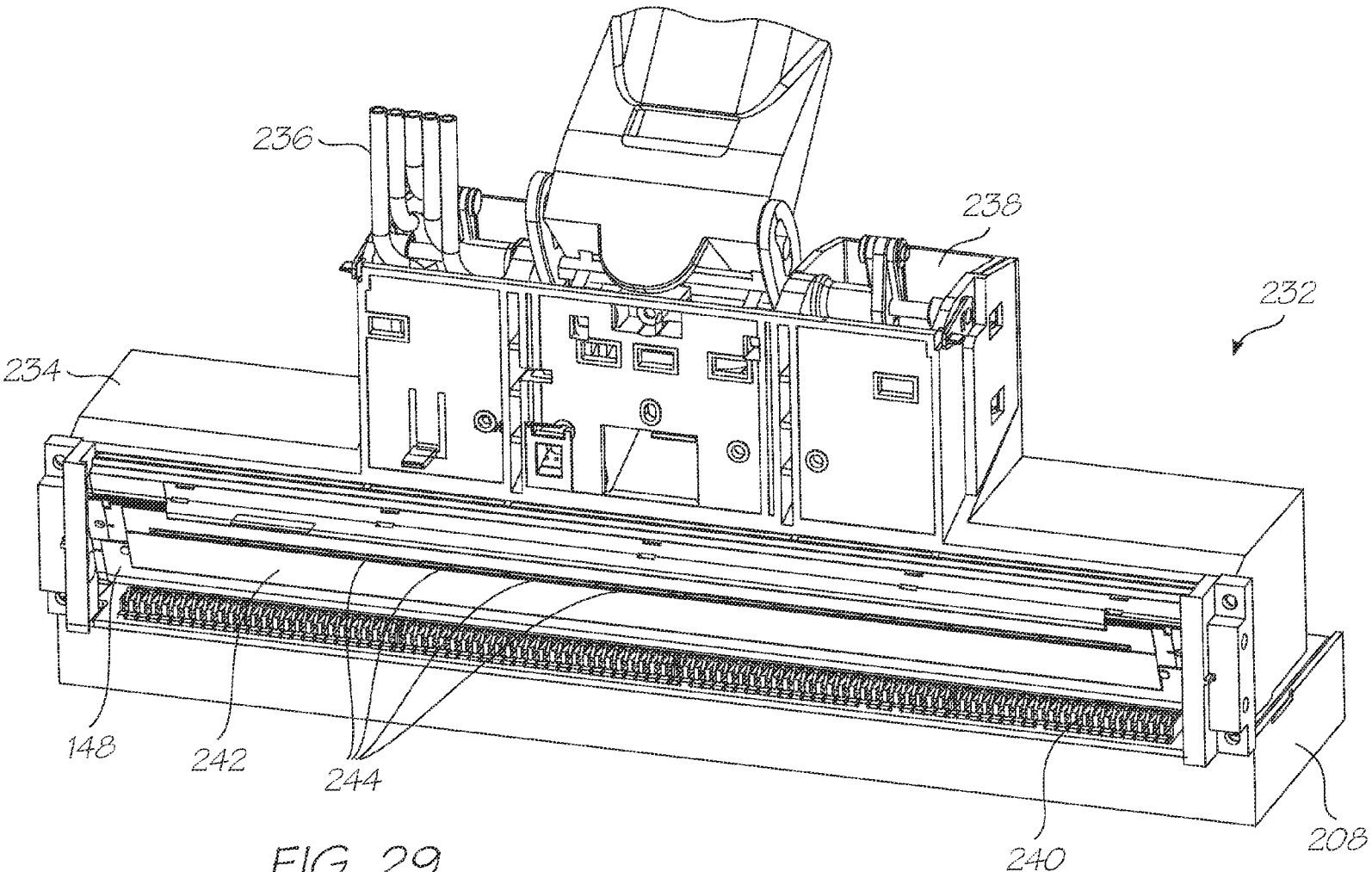

Each mounting site 84 has a printhead module interface 232 shown in FIG. 29. The printhead module interface provides the ink and electrical interface with the printhead module 148. The rectangular socket 234 is fixed to the mounting site 84 and the ink distribution system is connected to the ink supply interface 236 and the ink return interface 238. The opposing side of the socket 234 has the print engine controller (PEC) 208 for providing power and print data to the printhead module 148 under the overriding control of the central processor 210 in the storage cabinets 20 (see FIG. 23A). PEC 208 connects to the printhead module 148 via a line of sprung contacts 240 which engage contact pads on a TAB film 242 leading to a line of printhead integrated circuits (IC's) 244.

As discussed above, the printhead modules are comprehensively described in U.S. Ser. No. 12/845,723 filed Jul. 29, 2010 the contents of which are incorporated herein by reference.

Media Roller Frames

Figure 6:
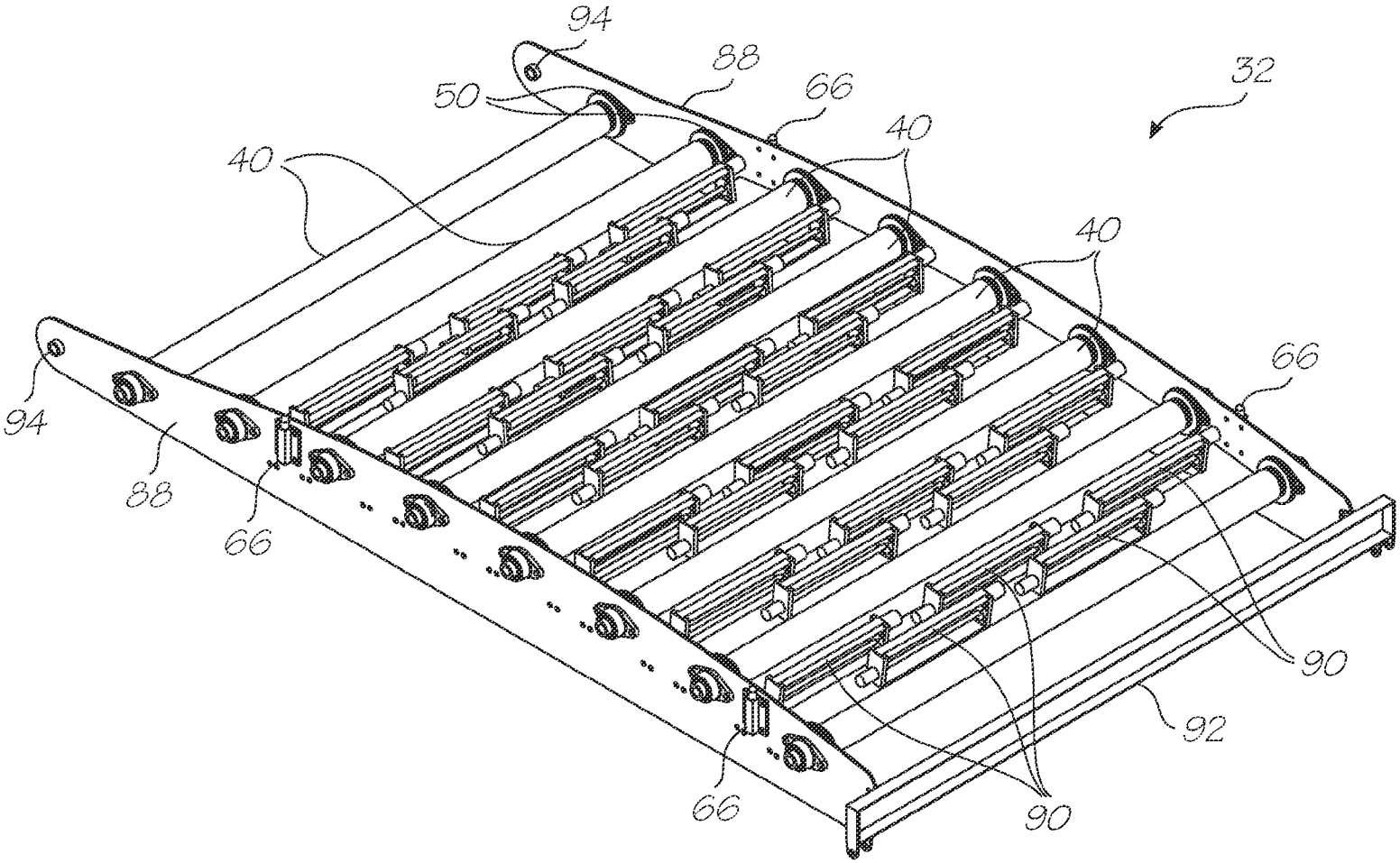
FIG. 6 is a perspective of the upper roller frame supporting the rollers and the maintenance stations beneath the pagewidth printhead assemblies.

FIG. 6 shows the upper roller frame 32 in isolation. The media rollers 40 extend between, and are rotatably mounted to, side plates 88. At one longitudinal end of each side plate 88 are roller frame hinge points 94. At the opposing ends is a jacking strut attachment plate 92 for the jacking strut 76 (see FIG. 4). On the outside face of each side plate 88 are the registration pins 66 and rotatably mounted at each end of the rollers 40 are the cable loop pulleys 50.

Between the side plates 88 are six maintenance assemblies, each comprising a sets of maintenance stations 90. Each set has five maintenance stations 90 positioned in registration with the corresponding five printhead modules in each cradle 82 of the upper printhead drawer 28.

Figure 13:
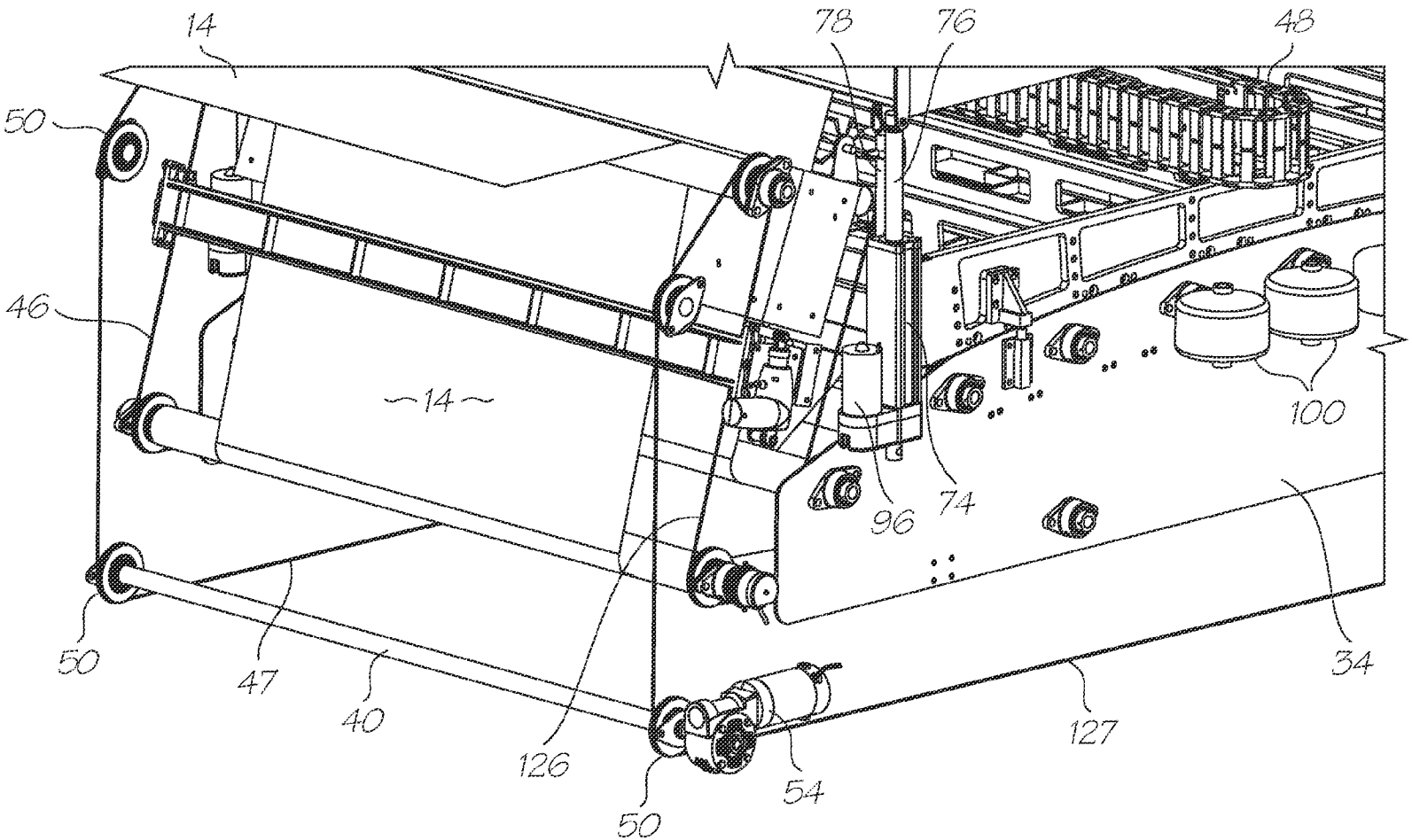
FIG. 13 is a perspective of the drive motor for the media web feed assembly.
Figure 14:
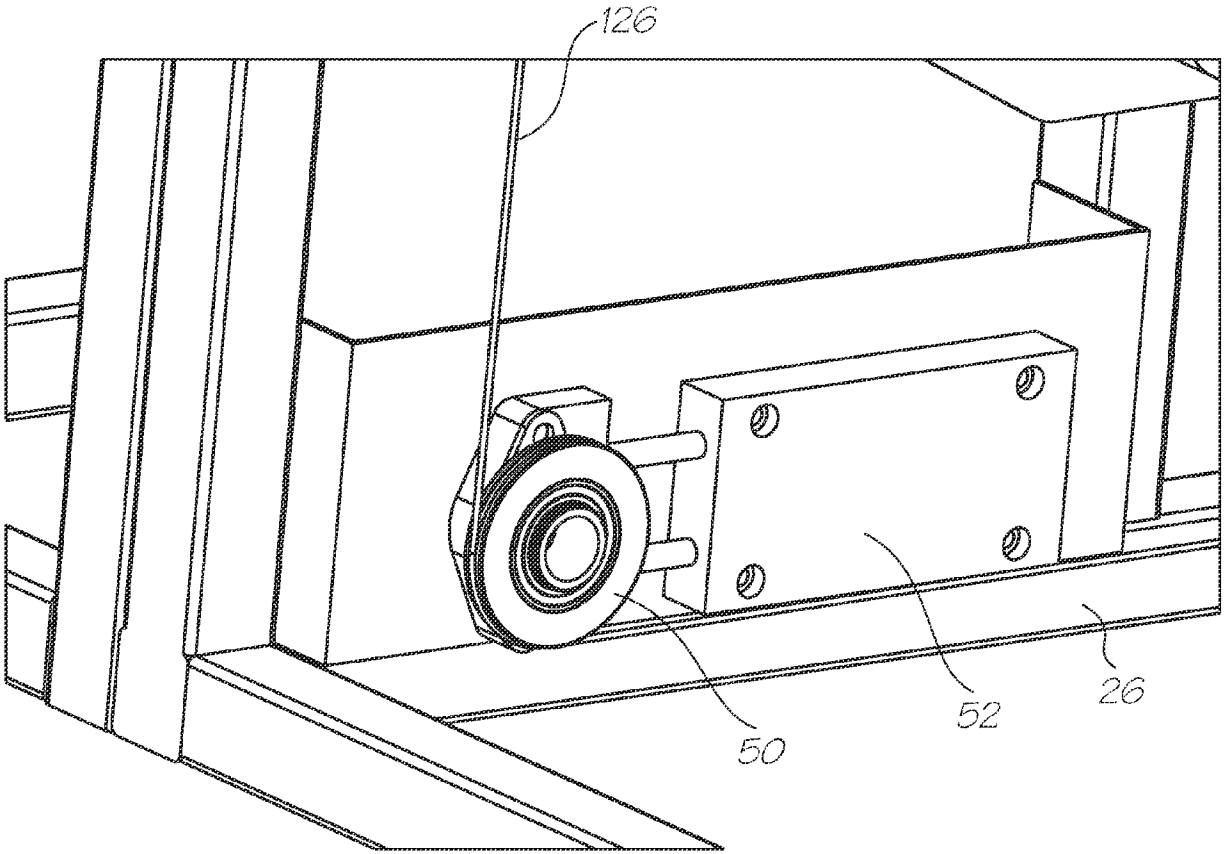
FIG. 14 is a perspective of a spring tensioner for a cable in the media web feed assembly.

FIGS. 7A and 7B are perspectives showing the upper roller frame 32 and the lower roller frame 34 in their lowered positions. The upper and lower roller frames are moved by front and back jacking mechanisms 74. FIGS. 4B and 13 best shown the back jacking mechanism 74. Front and back jack drive motors 96 retract their extendible struts 76 of the jacking mechanisms 74. The upper roller frame 32 falls away from the upper printhead drawer 28 about the upper roller frame hinge 70. Connecting rods 78 (see FIG. 4B) allows the lower roller frame 34 to also drop away from the lower printhead drawer 30 by pivoting about the lower roller frame hinge 72. Lowering the upper and lower roller frames 32 and 34 provides room for the web feed clamp 44 to pass between the printhead drawers and the roller frames.

Figure 8:
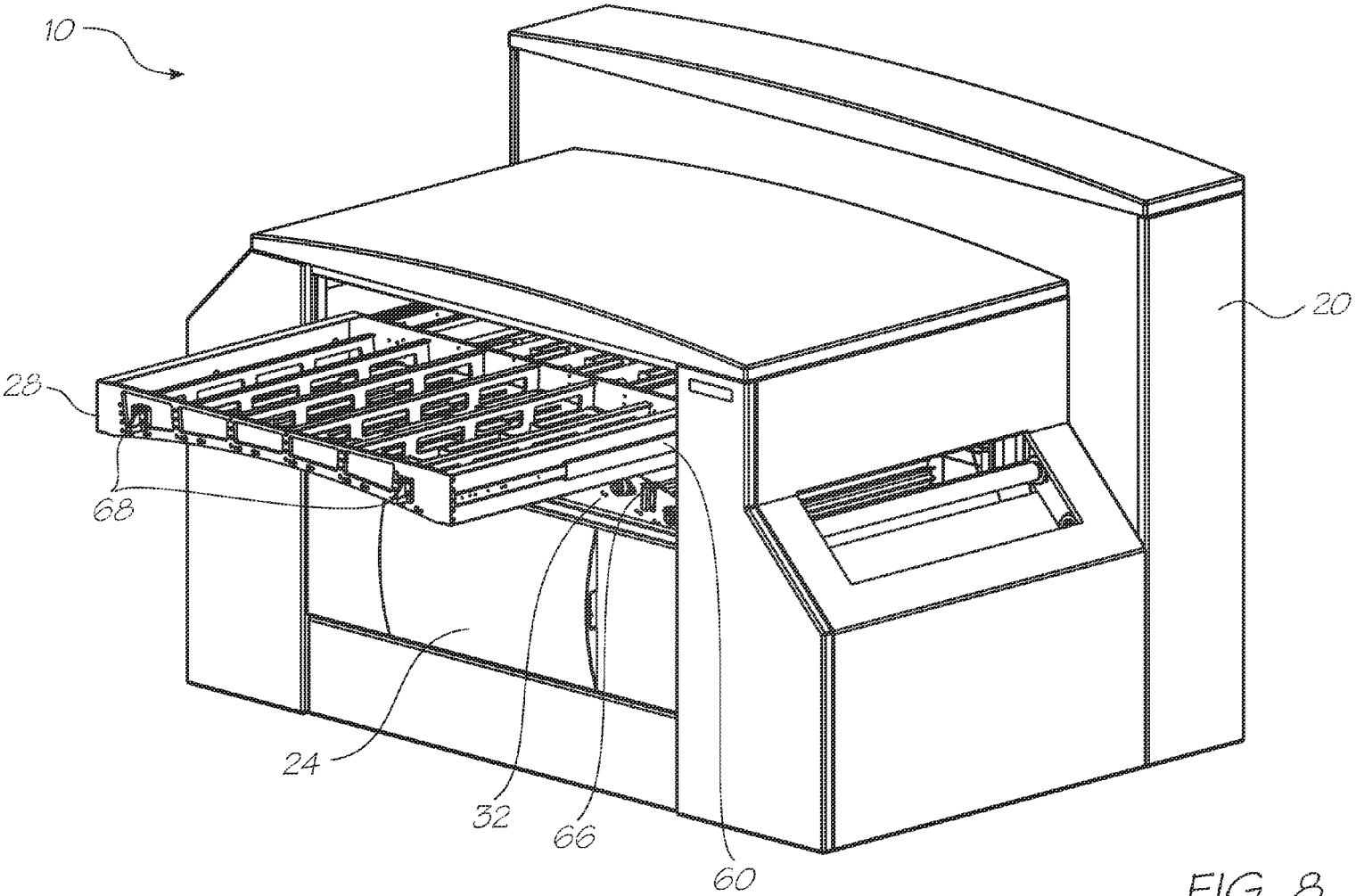
FIG. 8 is a perspective of the printer with the printhead drawer extended.

FIG. 8 is a perspective showing the upper drawer panel 22 removed and the upper printhead drawer 28 extended. With the upper roller frame 32 lowered, the upper printhead drawer 28 is easily pulled out of the printer 10 on the self centering roller slides 60. With the drawer extended, the printhead modules (not shown) are accessible for servicing such as removal and replacement.

Ink Distribution System

Figure 9:
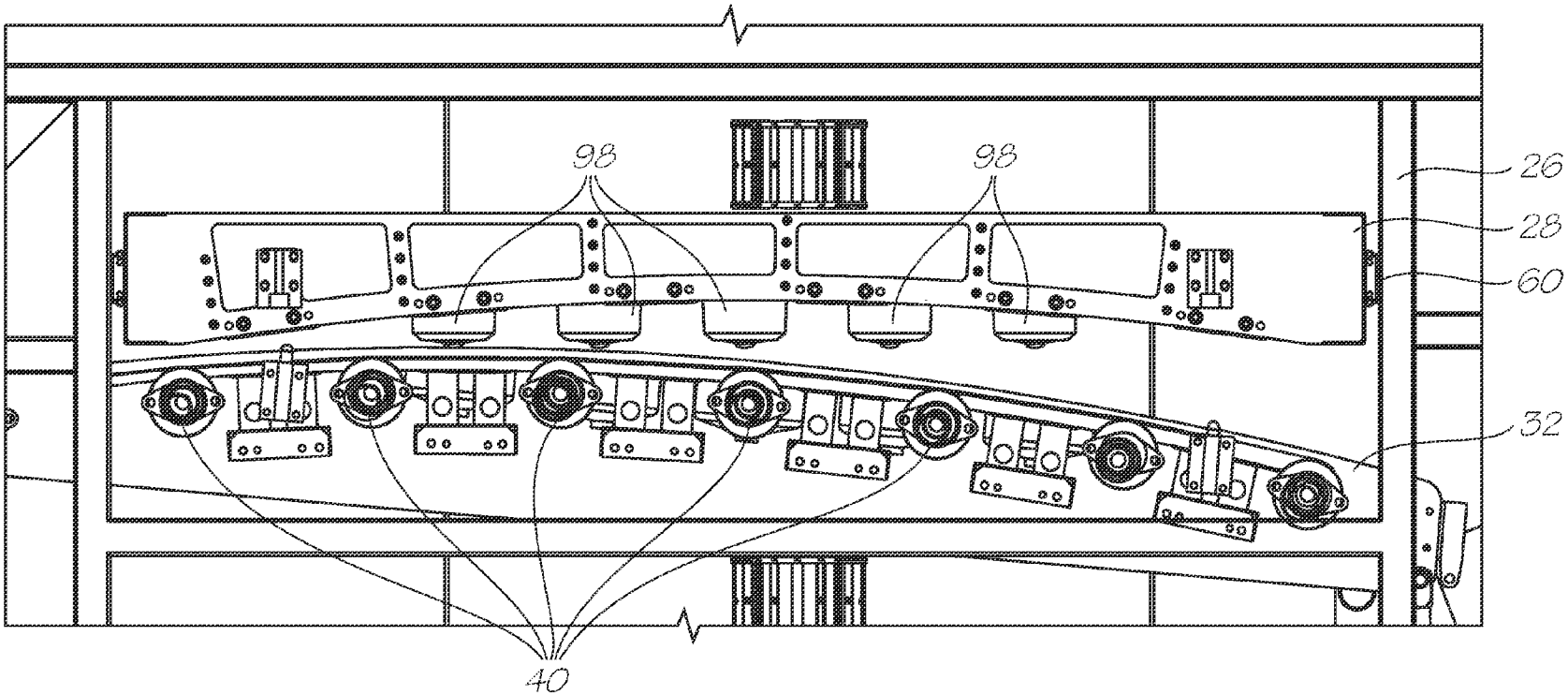
FIG. 9 is an enlarged elevation of the printhead drawer and the upper roller frame in the lowered position.

FIG. 9 shows the elevation of the upper printhead drawer 28 relative to the five upper ink header tanks 98. The ink header tanks supply the six pagewidth printhead assemblies in the upper printhead drawer 28 (with one of the header tanks supplying two of the printhead assemblies). The upper header tanks 98 are positioned such that they are at a slightly lower elevation than the printhead modules they supply. This generates a slightly negative hydrostatic pressure at the nozzles so that the ink meniscus at each nozzle does not bulge outwards when the nozzle is inactive. An outward meniscus makes the nozzle prone to leakage through wicking contact with paper dust or similar.

Figure 23A:
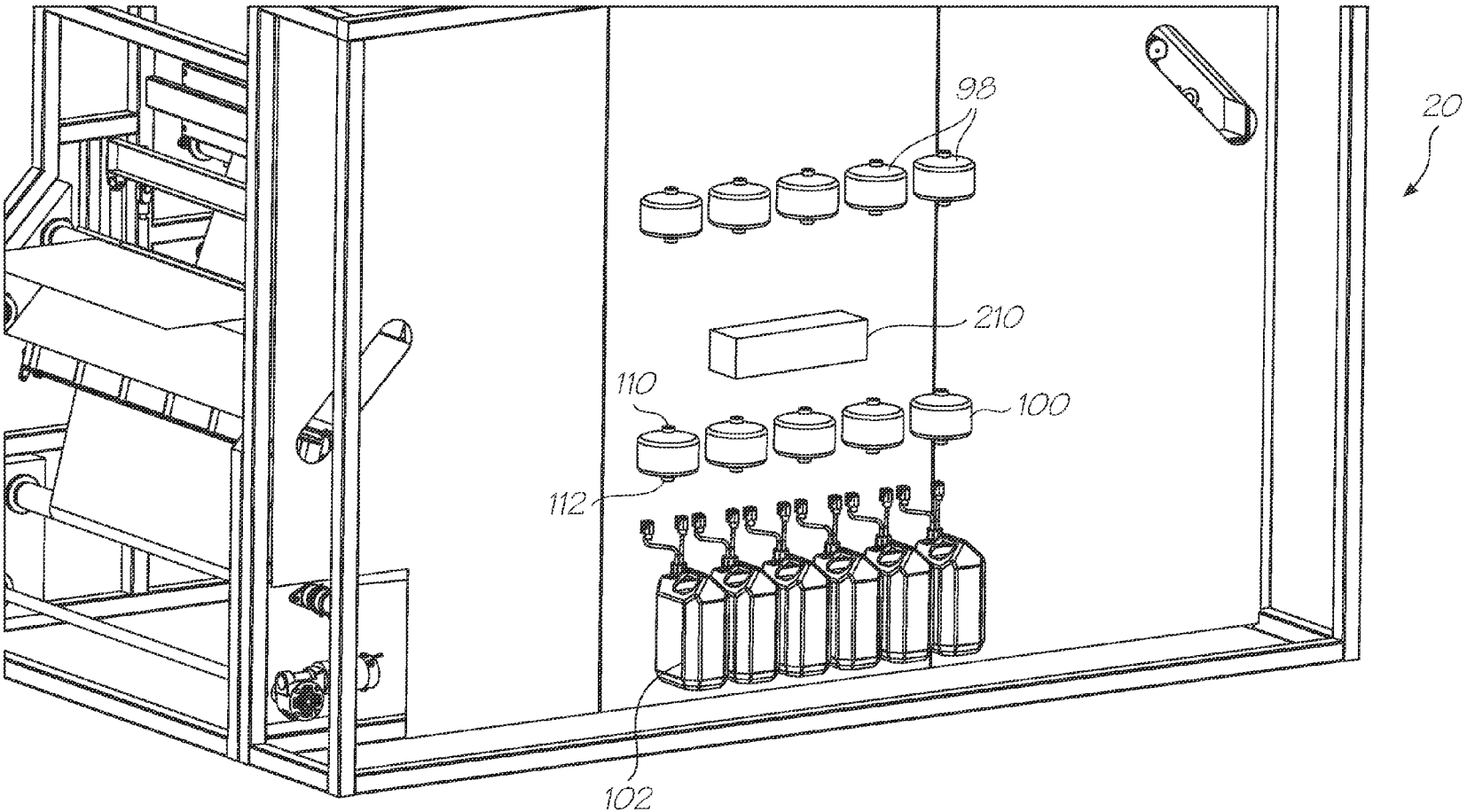
FIG. 23A shows the ink tanks and the intermediate header tanks.

FIG. 23A shows the upper printhead headers 98 and the lower printhead headers 100 (for supplying the printheads in the lower printhead drawer 30) together with the ink supply tanks 102. Six ink supply tanks 102 feed ink to the ten upper and lower header tanks. As discussed above, one of the upper header tanks 98 and one of the lower header tanks 100 supply two sets of printhead modules each. Hence, these header tanks are supplied by two supply tanks.

Figure 23B:
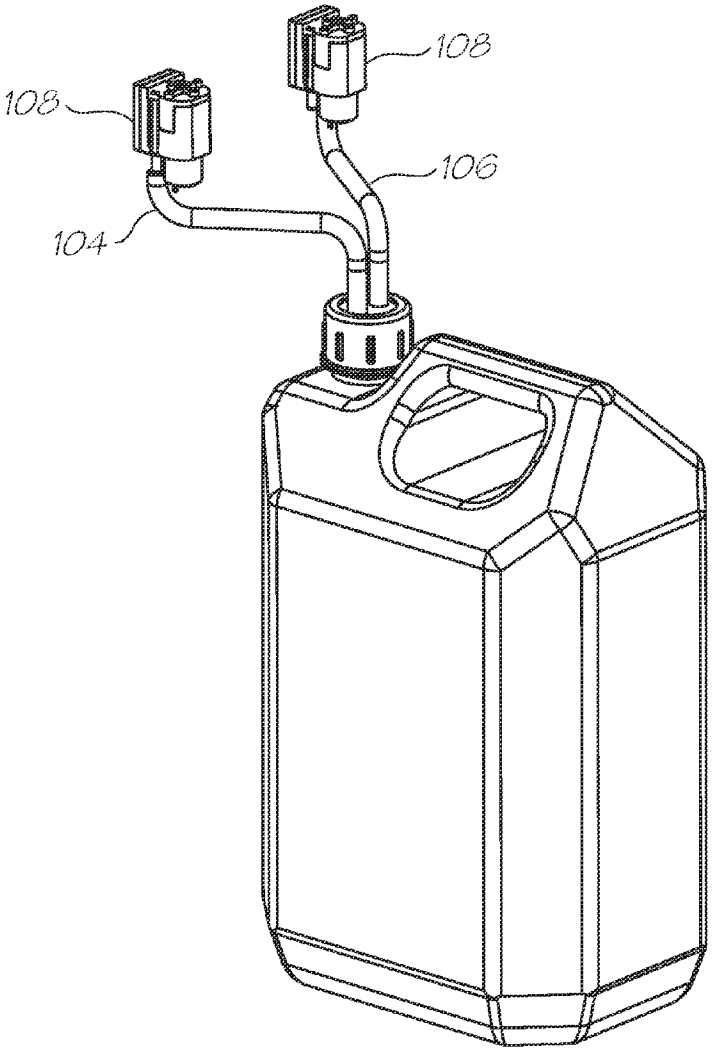
FIG. 23B is an enlarged perspective of a single ink tank with feed tube for the upper and lower printhead drawers.

The ink level in each of the header tanks is maintained in a narrow range. This in turn keeps the hydrostatic pressure at the nozzles within a narrow range. A float valve and or ink sensors are used to control the ink inflow. FIG. 23B shows one of the ink supply tanks 102 in isolation. Two supply lines extend from each ink tank 102—one line 104 to the lower header tank(s) 100 and the other line 106 to the upper header tank(s). The ink supply line connects to respective header inlets 110 at the top of each header tank. The header outlets 112 at the bottom of the header tanks lead to the printhead modules in the corresponding printhead set. A peristaltic pump 108 is fitted to all supply lines 104 and 106. Each peristaltic pump 108 has a spalling filter at its outlet to prevent contamination of the ink. These pumps 108 operate periodically in response to the ink sensors or float valve in the corresponding header tank.

To prime the printheads, the peristaltic pumps 108 partially fill the header tanks. Compressed air is fed to the head space in each of the header tanks so that ink is forced under pressure to the printhead modules. This system avoids any moving parts and the risk of contamination by spalling from a second set of peristaltic pumps. Pressure priming effectively purges air from the feed lines to each printhead module but causes an ink flood at the nozzles which is removed by the maintenance modules prior to printing.

Media Feed Path

Figure 17B:
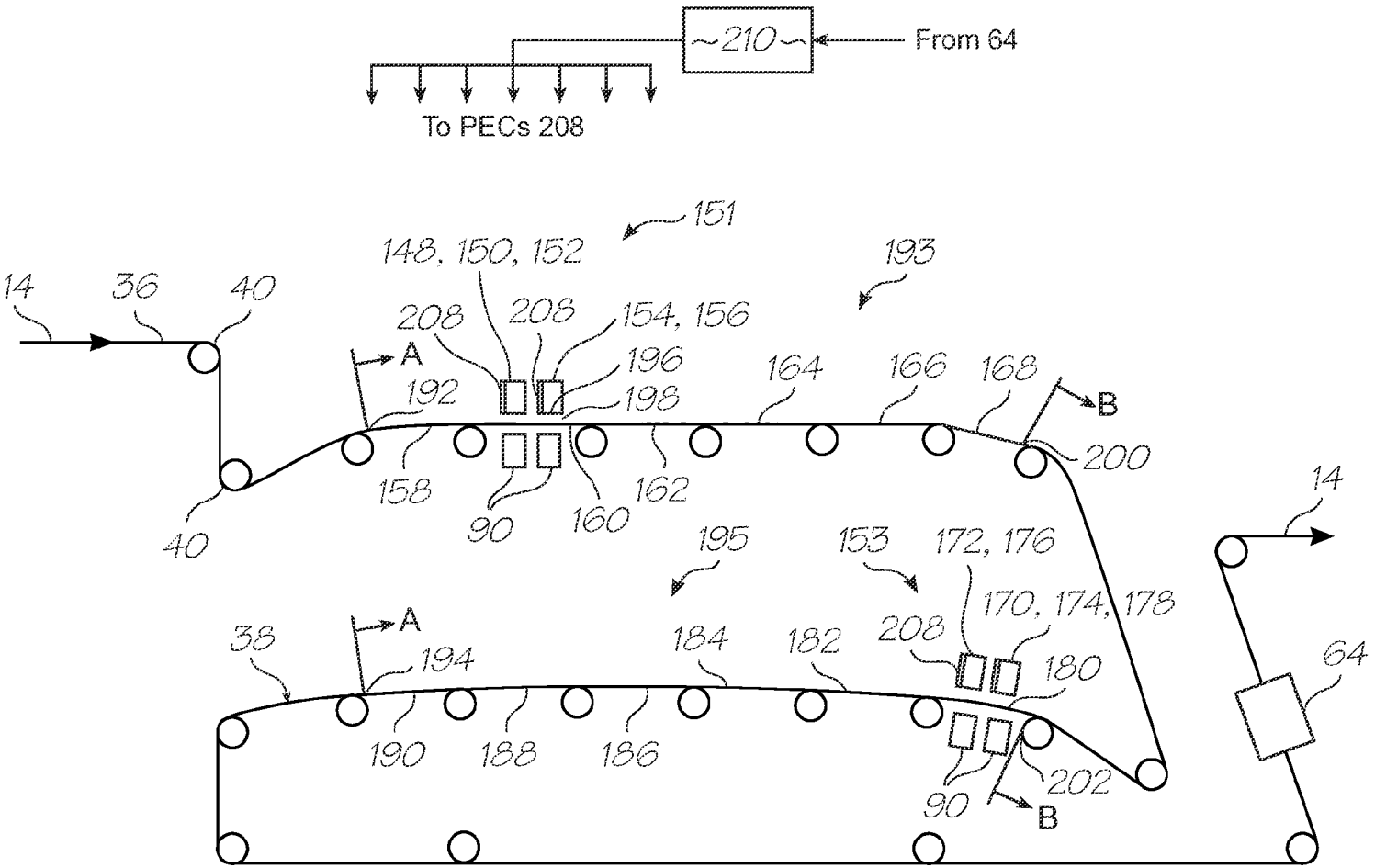
FIG. 17B is a diagrammatic elevation of an upper and a lower pagewidth printhead assembly and the opposing maintenance stations in relation to the media feed path.

FIGS. 17A and 17B show the media web 14 extending through the feed path together with a pagewidth printhead assembly 151 from the upper printhead drawer and one of the pagewidth printhead assemblies 153 from the lower printhead drawer. The upper printhead assembly 151 has five separately mounted printheads modules 148-156 for printing on one side of the media web 14. Likewise, the lower printhead assembly 153 has five individual printhead modules 170-178 to print the opposite side of the media web. As discussed above, the upper printhead drawer has six printhead cradles respectively mounting the pagewidth printhead assemblies 151 which print on feed path segments 158-168 respectively. Similarly, the lower printhead drawer supports another six pagewidth printhead assemblies which print on feed path segments 180-190 respectively. The upper and lower printhead feed path segments are flat segments of the feed path between two of the media rollers 40. In the interests of clarity, only one pagewidth printhead assembly from the upper and lower printhead drawers are shown.

The upper and lower printheads are mounted above their respective feed path segments for uniform ink supply and drop ejection characteristics. This requires a serpentine feed path where the upper feed direction is generally opposite the lower feed direction. The arc of the media roller axes in the upper feed path is generally parallel to the arc of the media roller axes on the lower feed path. This configuration reduces the footprint of the printer. The HP® Inkjet Web Press has the printheads for one side of the web positioned laterally adjacent the printheads for the opposing side. Between the two sets of printheads is a web turner (or 'turn bar', as it is sometime called). This configuration has a media feed path length of well over 400 inches (approx. 10 m) and consumes a great deal of floor space. The serpentine feed path and vertically stacked printhead drawers used by the present invention keep the footprint to less than 15 $m^2$ and in most cases less than 10 $m^2$.

While the specific embodiment shown in the drawings has the serpentine feed path positioned such that the upper print zone 193 is vertically above the lower print zone 195 (see FIG. 17B), the meander of the serpentine path could also extend vertically or diagonally to achieve similar footprint reductions. In view of this, the upper print zone should be more broadly thought of as a first print zone 193 and the lower print zone thought of as a second print zone 195. The first print zone 193 is upstream of the second print zone 195, and the media feed direction in the first print zone should be generally opposed to that of the second print zone.

The overall length of the feed path is also shorter. The printhead modules are configured to eject low volume ink droplets; less than 2 pico-liters and more often less than 1.5 pico-liters. In the embodiment shown, the drop size is 1.1 pico-liters, ±0.1 pico-liters. The low drop volumes dry relatively quickly when printed on the media web which shortens the length of the feed path from the start 192 of the upper print zone (i.e. the upper print zone segments 158-168) to the end 194 of the feed path of the lower print zone 195 (the length A-A shown in FIG. 17B) to substantially less than 10 m and usually less than 5 m. The embodiment shown the length is 3.535 m.

Small quick drying ink droplets also reduce the length B-B shown in FIG. 17B. This is the end 200 of the upper print zone 193 to the first point of contact 202 with a media roller on the freshly printed side of the media web. Ordinary workers will appreciate that there are many factors that govern the length B-B such as the feed speed, the type of media (glossy or otherwise), droplet volume, ink type, the use of infra-red heaters and so on. With a media feed speed of between 1.5 m/s and 2.0 m/s and a droplet volume less than 2 pico-liters, the length B-B is comfortably less than 4 m and usually less than 2 m even without the use of heaters to dry the ink.

As best shown in FIG. 4B, the printer has two IR (infra red) heaters 56 and 58 for additional control of the ink drying rate. The upper IR heater 56 is adjacent the downstream end of the upper print zone 193 and the lower IR heater 58 is downstream of the lower print zone 195. Using the IR heaters 56 and 58 allows the media feed speed to remain at the upper end of the 1.5 m/s to 2.0 m/s media feed speed range, when printing at 100% coverage, photographic resolution on glossy paper.

The continuous web printer of the present invention has a media feed speed of between 1.5 m/s and 2.0 m/s. The printer does not drive the media web itself, but instead uses the drive on the unwinder and winder. These are not run at the speed (approx. 3.5 m/s to 4.0 m/s) of a traditional high end web printer and so is not suitable for printing editions of national newspapers or similar. However, for smaller print runs, the web printer of the present invention is particularly versatile. The ease with which the web is threaded through the printer allows the operator to be unskilled and the small footprint allows the printer to have a presence in shopping malls for very small print runs.

Scanner

Figure 18:
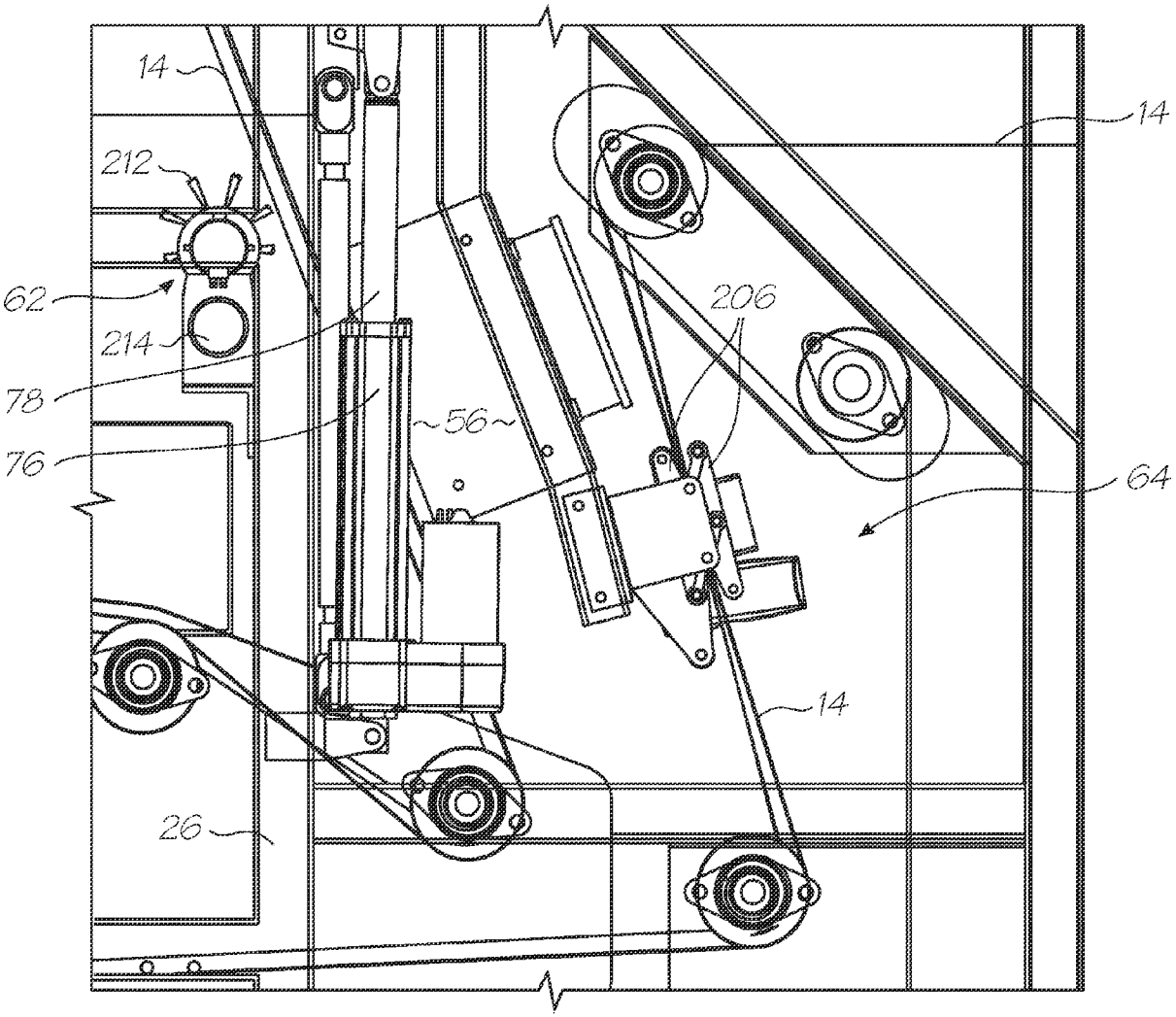
FIG. 18 is an enlarged elevation of the scanner.
Figure 19:
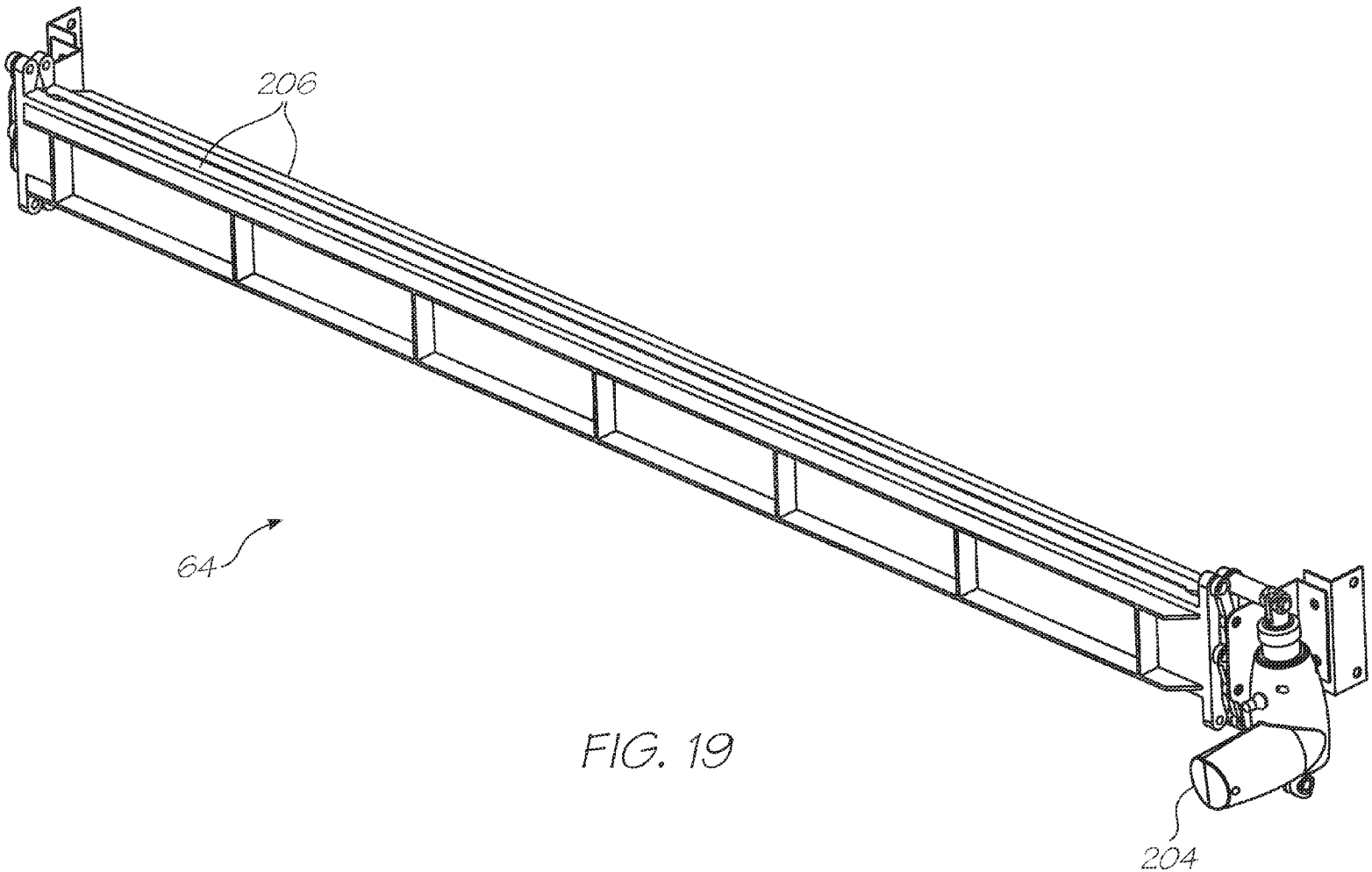
FIG. 19 is a perspective of the scanner in isolation.
Figure 20:
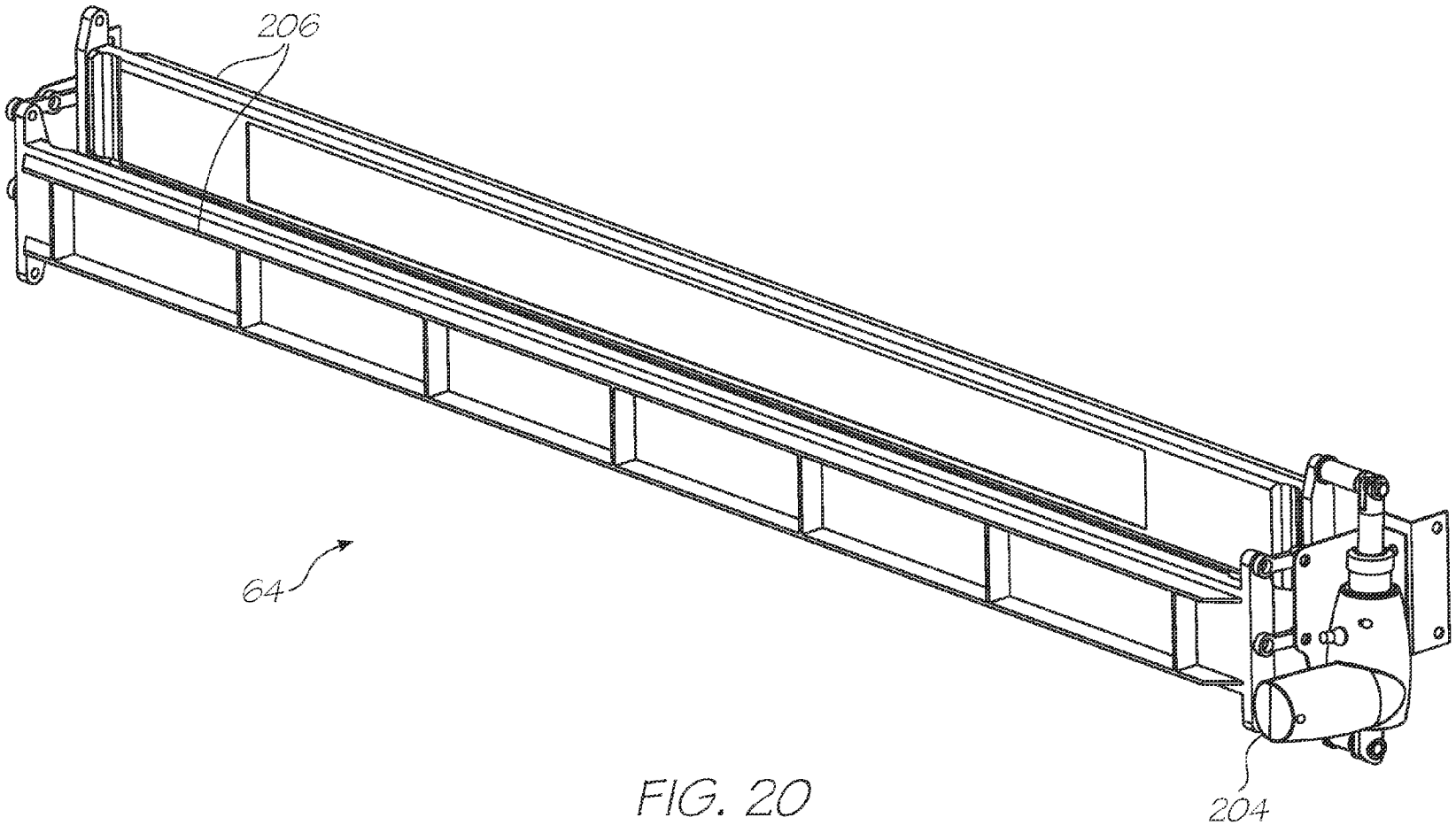
FIG. 20 is a perspective of the scanner in an open configuration.

After threading a new media web through the printer, a test dot pattern is printed by each of the printhead modules (e.g. 148, 150, 152, 154 and 156 of FIG. 17B). The scanner 64 views the printed dot pattern on both sides of the web simultaneously. The scanner 64 is shown in the partial enlarged elevation of FIG. 18. FIGS. 19 and 20 are perspectives showing the scanner 64 in isolation. During use, the side plates 206 of the scanner 64 are in the closed position shown in FIGS. 18 and 19. However, when the media web is being threaded through the printer on the web clamp 44, the plates open as shown in FIG. 20. The scanned image data of the printed dot pattern is transmitted via the scanner output 204 to the central processor 210 (see FIG. 17B) typically installed in the cabinets 20 together with the ink tanks. The central processor 210 compares the scanned images to a reference dot pattern corresponding to all printhead modules, and all pagewidth printhead assemblies in correct registration with each other. The central processor 210 then electronically adjusts the printing from each of the printhead modules via their respective print engine controllers 208 (see FIG. 17B).

Customized Content within Single Print Run

The media web is commonly marked with periodic fiducial codes for correct registration between the print on both sides of the web. The scanner 64 reads and transmits the fiducial codes to the central processor 210 for any corrective adjustments to the registration of the printing from individual printhead modules. The central processor 210 of the present web printer can use these fiducial codes to customize some of the printed content in one or more of copies within a print run. Subscriber profile data can be used to tailor the advertising within particular copies for individual subscribers. Similarly, the content within the publication can be personalized to match the subscriber interests.

Print data for the print run is periodically downloaded from the central processor 210 to the individual printhead modules and buffered in their respective print engine controllers 208. Typically the print run will be many (say more than 1000) identical copies of a single publication or document. The processing capability of the central processor 210 coupled with the individual print engine controllers 208 allow the printer to generate one or more non-identical copies without interruption or delay to the print run.

Selectively altering one or more of the copies to be non-identical to the remainder of the copies without interruption to the print run allows publishers to customize content for particular markets or even individual subscribers.

Depending on its capacity of the memory buffer, each of the print engine controllers 208 may store the print data for the identical copies as well as print data related to alterations. However, if each copy is a large document, and/or the number of alterations is large, the central processor 210 can transmit print data to the print engine controllers 208 during the print run. Using the fiducial codes on the web, the printhead modules can be instructed to generate a non-identical copy shortly before it is printed.

The altered print data in each of the non-identical copies relates to advertising. The advertising may be more geographically relevant to the intended readers of the non-identical copies whereas the altered content may be of little relevance to the majority of the readers.

The print run is a publication for general sale as well as sale to subscribers. The central processor 210 alters the publication for individual subscribers in accordance with individual subscriber profiles. The central processor 210 accesses the individual subscriber profiles from a database with information such as:

subscriber address;
gender;
age;
personal interests; or,
purchasing history.

Particulate Trap

Figure 21:
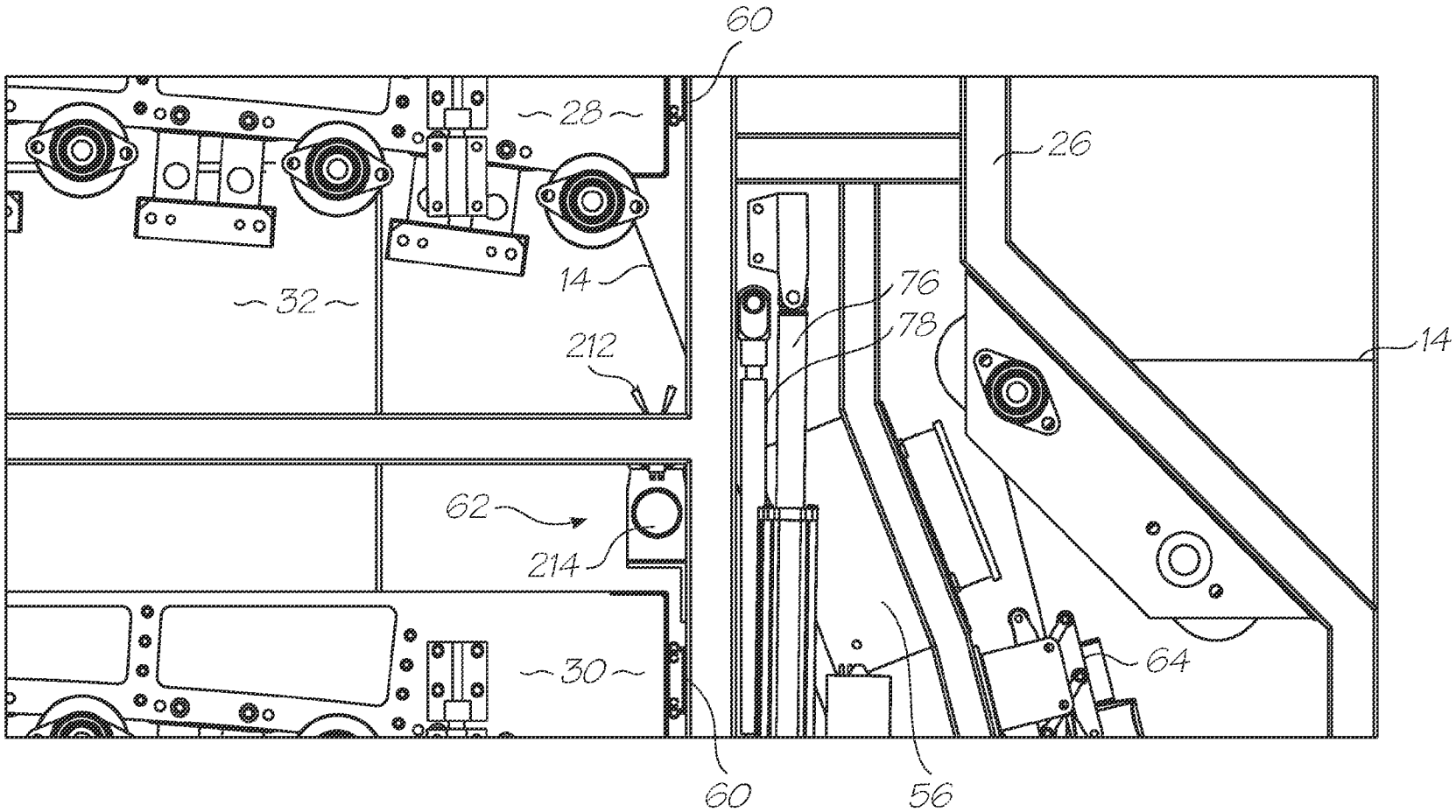
FIG. 21 is an enlarged partial elevation of the interior showing the position of the particle trap.
Figure 22:
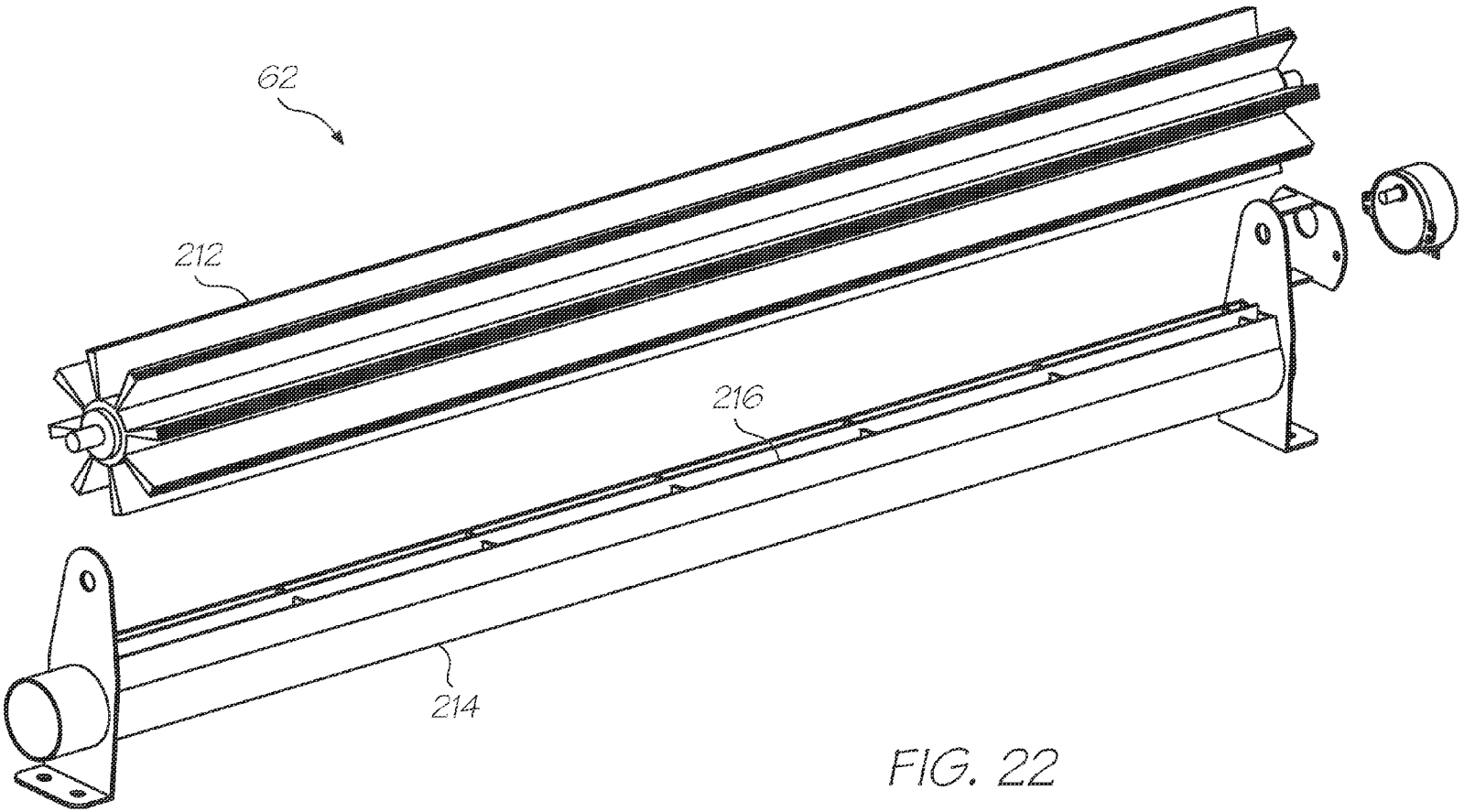
FIG. 22 is an exploded perspective of the particle trap in isolation.

FIGS. 21 and 22 best show the features of the particulate trap 62. The particulate trap 62 is mounted adjacent the feed path between the upper roller frame 32 and the lower printhead drawer 30. Rotating blades 212 brush the web surface to remove paper dust, dried ink aerosol or other particulates. The blades 212 continue to rotate around to the longitudinal vent 216 of a vacuum tube 214. The particulate contaminants are drawn off the blades 212 as they are dragged over the vent 216 and sucked into the air flow through the vacuum tube 214. Removing the particulate contaminants from the web surface prior to printing reduces print artifacts and particulate contamination of the nozzle arrays 196 (see FIG. 17B).

Air Platen

FIGS. 24A to 28 show another embodiment which replace the upper and lower roller frames 32 and 34, with air platen frames 218. Where the air platen frame 218 and the upper roller frame 32 have corresponding or equivalent features, they are indicated with the same reference numeral.

Figure 26:
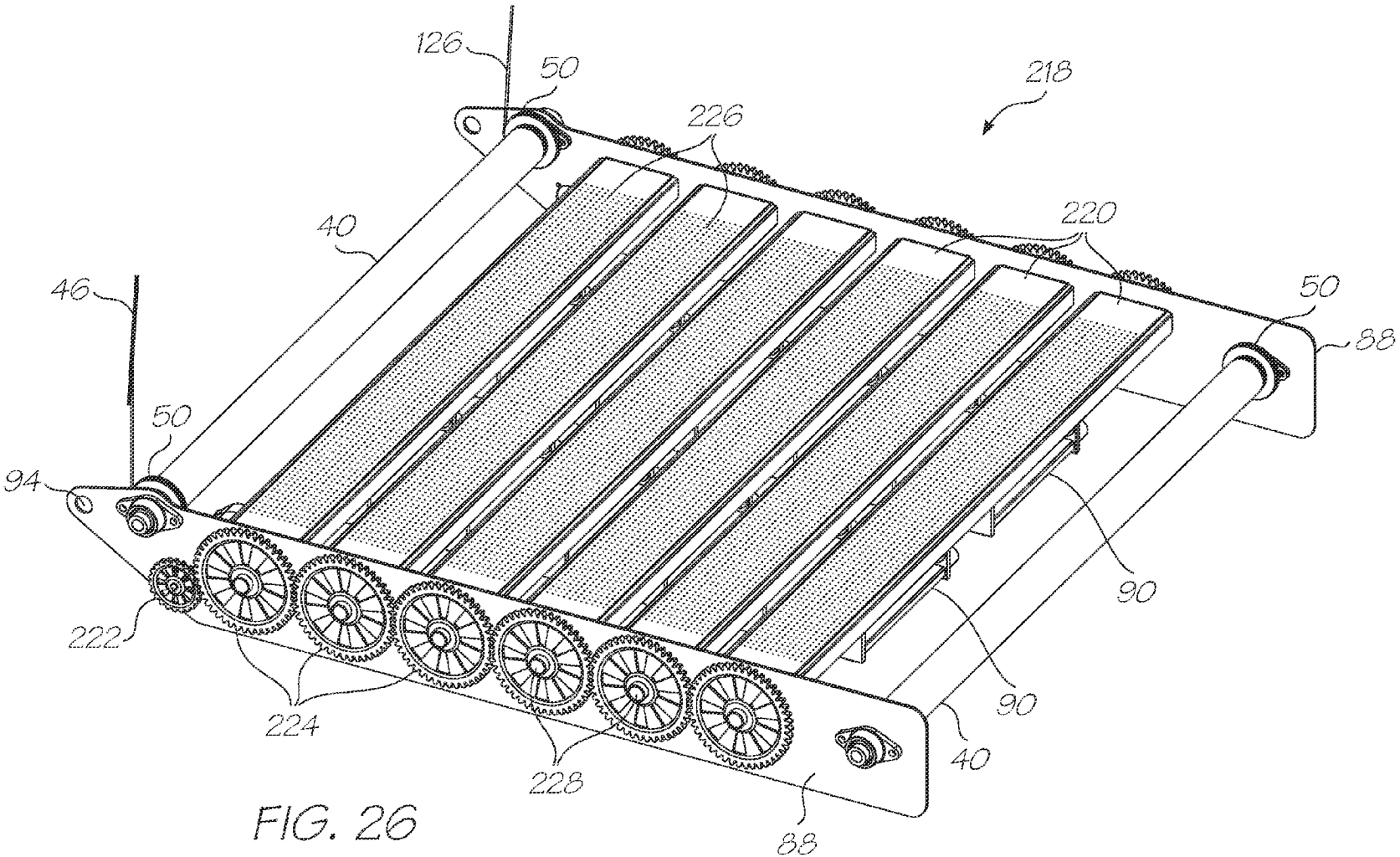
FIG. 26 shows air platen assemblies mounted in a platen frame.
Figure 27:
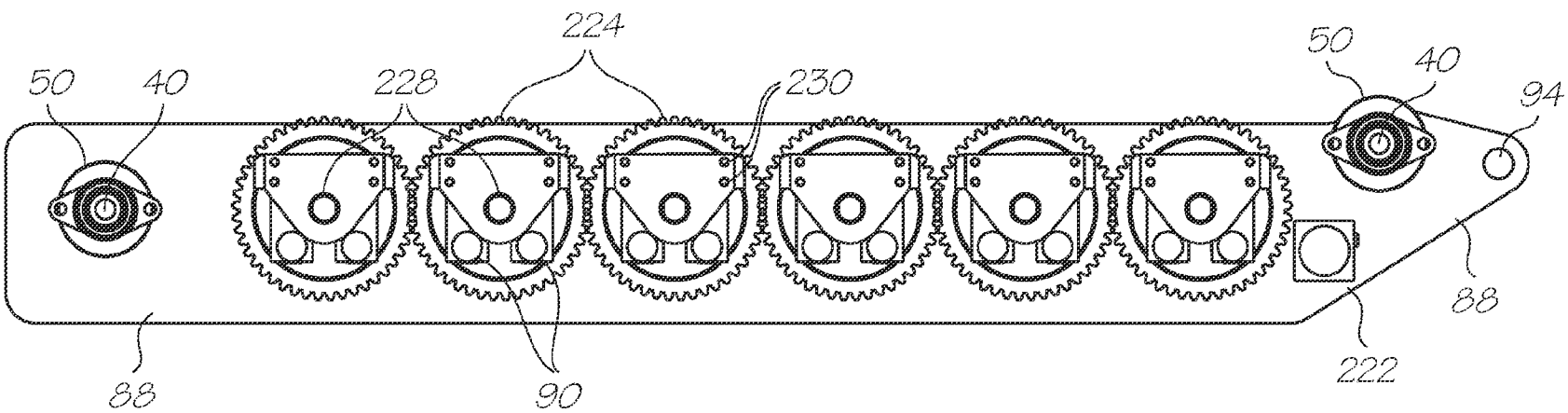
FIG. 27 is an elevation of the platen frame with meshing rotation cogs and drive motor removed for clarity.

FIG. 26 shows the air platen frame 218 in isolation. Six individual air platens 220 are supported on platen shafts 228 rotatably mounted between side plates 88. At the upstream and downstream ends of the air platens 220 are media rollers 40. As with the previous embodiment, these rollers 40 have cable pulleys 50 at either end for the web feed cables 46 and 126. On the underside of each air platen 220 are the five maintenance stations 90 for the five printhead modules 148-156 (see FIG. 17A) that span the media web 14 opposite each platen. At the front end of each of the platen shafts 228 are platen turn gears 224. These form a line of meshing spur gears, the first of which also meshes with a platen shaft drive gear 222. The platen shaft drive gear 222 can be manually engaged or linked to a powered drive. Rotating the platen drive gear 222 turns the gears 224 in unison so that all six sets of maintenance stations 90 present to the printhead modules.

Figure 28:
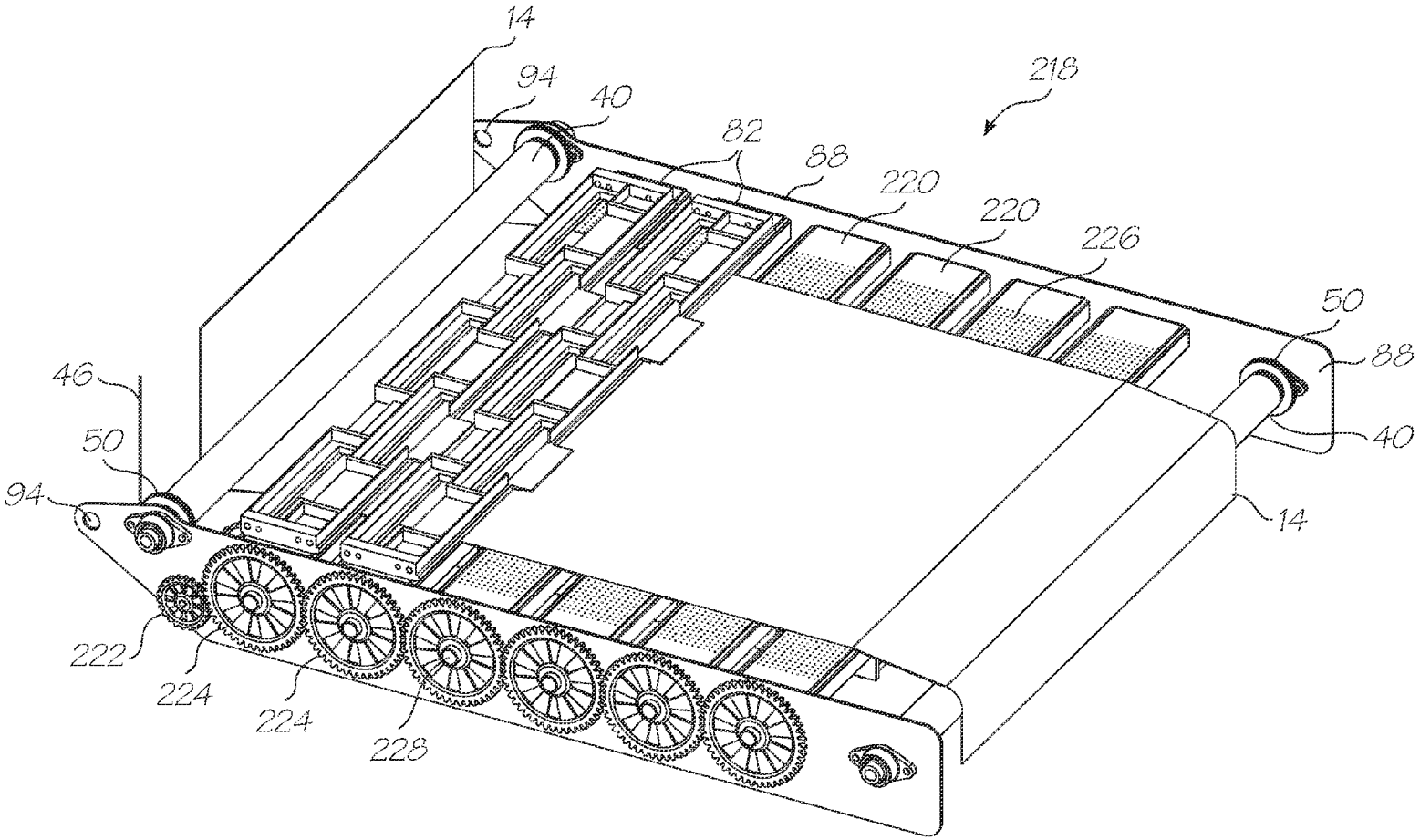
FIG. 28 is a perspective of the rear of the platen frame with the meshing rotation cogs and the web of media together with the printhead cradles for two of the pagewidth printhead assemblies; and, FIG. 29 is a perspective of a printhead module in the interface that fits to a printhead mounting site within one of the printhead cradles.

FIG. 28 shows the air platen frame 218 together with the media web 14 and two of the printhead assembly cradles 82. As with the previous embodiment, the printhead cradles 82 are supported in a printhead drawer which has been omitted from FIG. 28 for the purposes of illustration. The air platen frame 218 can be lowered away from the printhead drawer by rotating down about the hinge 94. This allows the media web 14 to be threaded through the feed path by the web clamp travelling on the cable loops 46 and 126. It also allows the platens 220 to rotate the maintenance modules 90 into place.

Figures 24A, 24B:
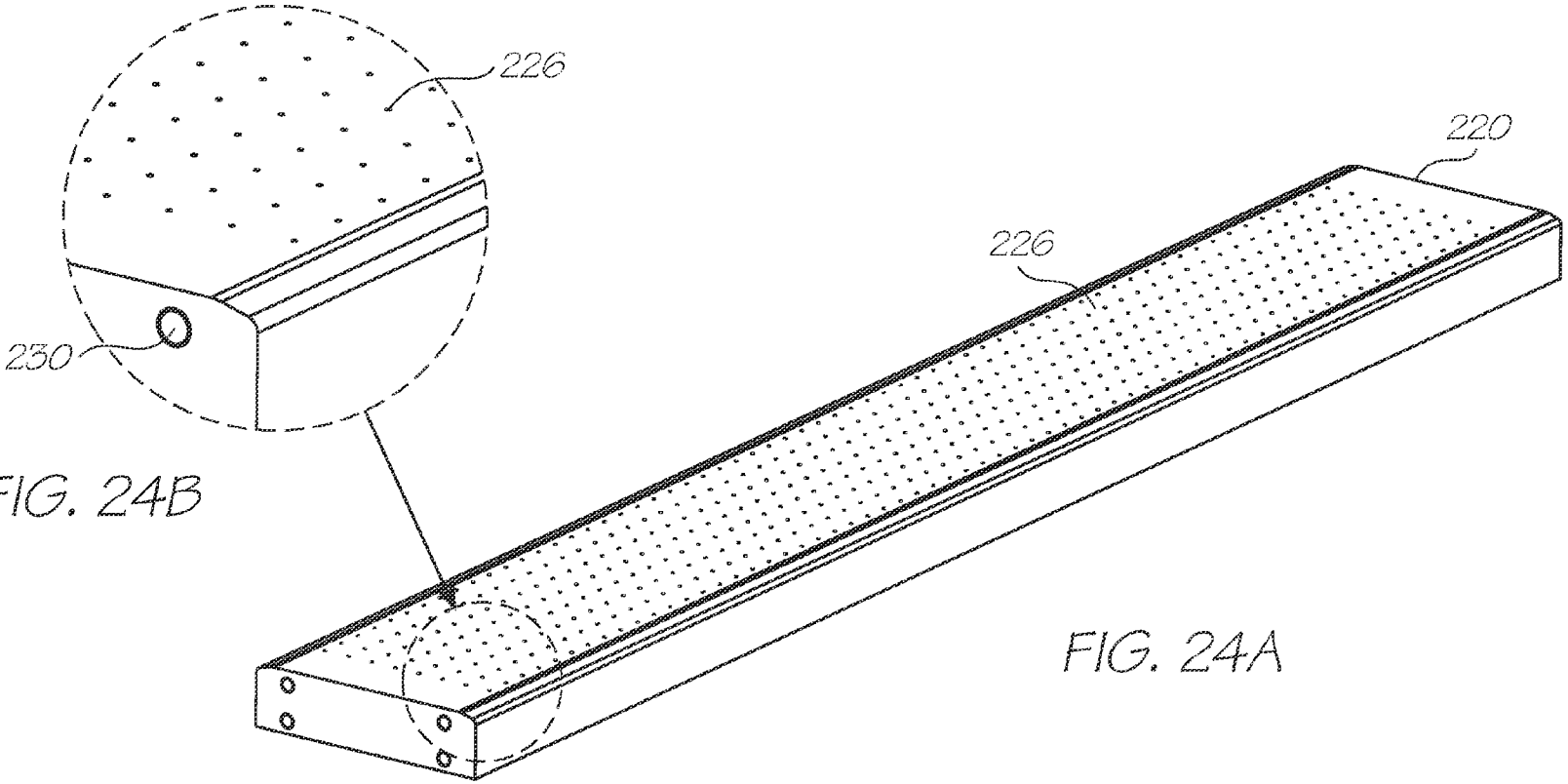
FIGS. 24A and 24B are perspectives of an air platen.
Figure 25:
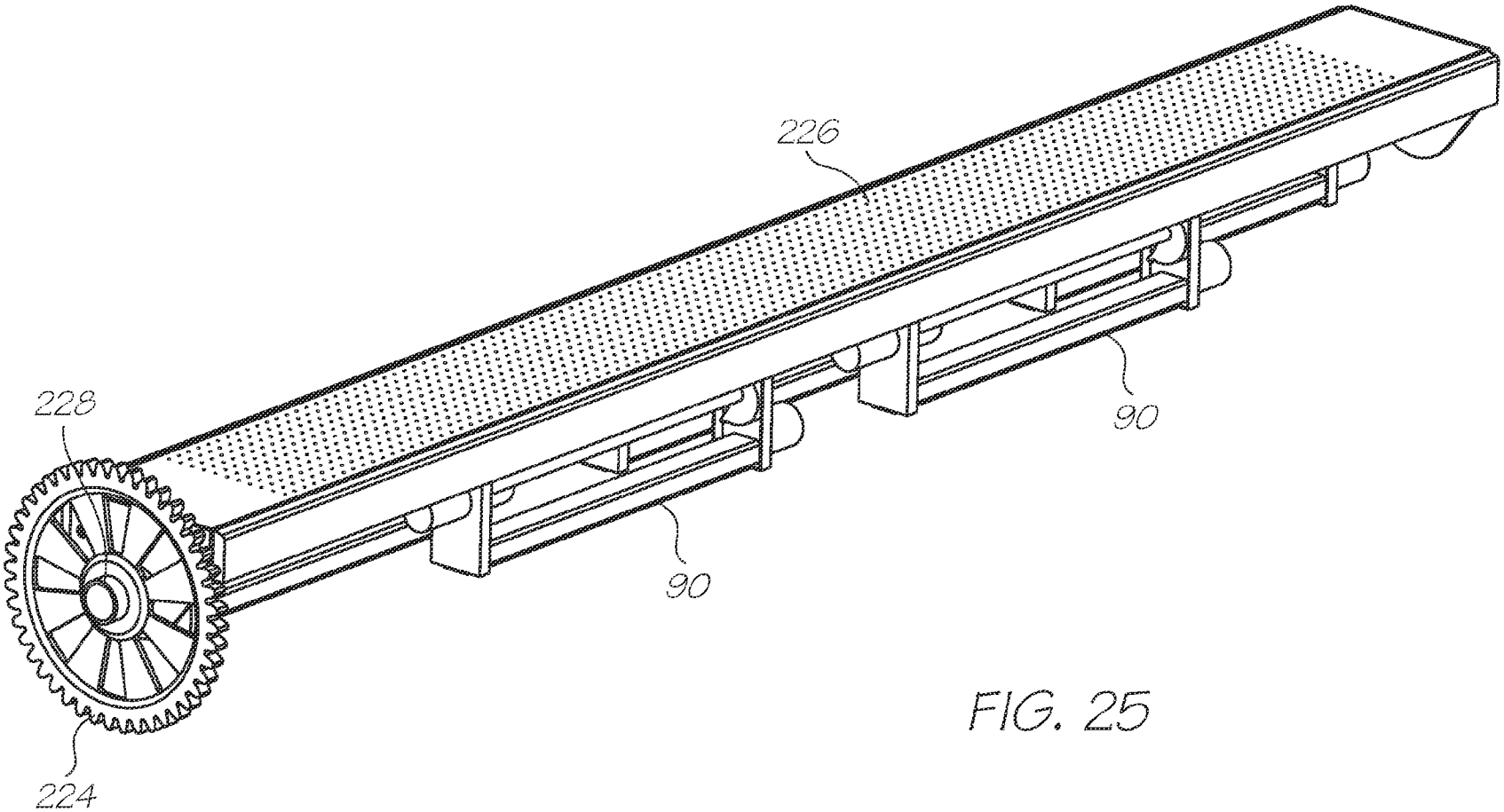
FIG. 25 shows a rotatable air platen and maintenance station assembly.

FIGS. 24A and 24B show one of the platens 220 in isolation. Air inlets 230 at the rear facing end of the platen 220 are in fluid communication with a pressurized air source (not shown). The air flow is distributed across the apertured surface 226 to generate an air cushion or air bearing similar to that of an air hockey table. The media web 14 is supported on the air cushion as it is fed past the printhead modules. The positional control of the media web provided by the air cushion is satisfactory for printing without visible artifacts. The variation in the print gap 198 (see FIG. 17B) between the nozzles 196 and the media 14 is less than ±10 microns. The air platens 220 also reduce friction on the media web to practically zero. Hence there is less drag on the winder and unwinder which drive the media web through the printer.

The continuous web printer shown here has a compact form and low production cost relative to traditional continuous web presses and even the more recent HP® Inkjet Web Press which uses inkjet printheads. The 1.5 m/s to 2.0 m/s media feed speed equates to printing a 3000 page book in a minute. With the small footprint, and automated web threading, and the print run flexibility of the central processor, the web printer can be installed in a retail shop or shopping mall where books or publications are printed on demand.

The present invention has been described herein by way of example only. Skilled workers will readily understand many variations and modifications are possible without departing from the spirit and scope of the broad inventive concept.

The invention claimed is:

1. A continuous web printer comprising:

an inlet for receiving a web of media from a media web roll unwinder;

an outlet for delivery to a media web roll winder;

a media feed path extending between the inlet and the outlet;

an air platen frame having a plurality of air platens for supporting the web of media through a print zone, each air platen having an air inlet and a flat apertured surface for generating an air cushion; and, a plurality of pagewidth inkjet printhead assemblies positioned opposite the plurality of air platens.

2. A continuous web printer according to claim 1 wherein each of the air platens has a maintenance assembly and mounted for rotation such that the maintenance assembly is presented to one of the pagewidth inkjet printhead assemblies.

3. A continuous web printer according to claim 2 wherein the pagewidth inkjet printhead assemblies each comprise a set of inkjet printhead modules and the maintenance assembly comprises a set of maintenance stations, one maintenance station for each of the printhead modules respectively.

4. A continuous web printer according to claim 3 comprising an upper air platen frame and a lower air platen frame, the upper and lower air platen frames configured to generate air cushions defining upper and lower print zones respectively.

5. A continuous web printer according to claim 4 wherein the lower print zone is positioned vertically beneath the upper print zone.

6. A continuous web printer according to claim 4 wherein the upper and lower air platen frames each have a plurality of air platens, each of the air platens having an air inlet and a flat apertured surface for generating the air cushion.

7. A continuous web printer according to claim 4 wherein each of the air platens has a maintenance assembly and mounted for rotation such that the maintenance assembly is presented to one of the pagewidth inkjet printhead assemblies.

8. A continuous web printer according to claim 7 wherein the maintenance assembly comprises a set of maintenance stations, one maintenance station for each of the printhead modules respectively.

9. A continuous web printer according to claim 5 wherein during use the web is fed along the media feed path in a feed direction, the feed direction in the upper print zone opposing the feed direction in the lower print zone.

10. A continuous web printer according to claim 9 wherein the media feed path extends less than 10 meters from a point where during use, the web is blank, to a point where both sides of the web are printed.

11. A continuous web printer according to claim 4 wherein the lower print zone is less than 4 m downstream along the media feed path from the upper print zone.

12. A continuous web printer according to claim 1 wherein the web printer occupies a footprint of floor space, the footprint being less than 15 $m^2$.

13. A continuous web printer according to claim 12 wherein the footprint is less than 10 $m^2$.

14. A continuous web printer according to claim 1 wherein pagewidth inkjet printhead assemblies eject ink droplets with a volume less than 2 pico-liters.

15. A continuous web printer according to claim 1 further comprising a printhead drawer for mounting at least one of the pagewidth inkjet printhead assemblies adjacent the media feed path; wherein, the printhead drawer is configured to move transverse to the media feed path such that the at least one pagewidth inkjet printhead assembly is exposed for servicing.

16. A continuous web printer according to claim 15 further comprising a chassis wherein the printhead drawer is mounted to the chassis via a pair of roller bearing slides, each of the roller bearing slides having a drawer track secured to the printhead drawer, a chassis track secured to the chassis and an intermediate track positioned between the chassis track and the drawer track, such that the drawer track and the intermediate track define a drawer roller bearing race and the chassis track and the intermediate track define a chassis bearing race.

* * * * *